US006918339B2

(12) United States Patent
Yamamoto et al.

(10) Patent No.: US 6,918,339 B2
(45) Date of Patent: Jul. 19, 2005

(54) METHOD OF CONTROLLING A FEED RATE OF DAMPENING WATER IN AN OFFSET PRESS

(75) Inventors: Takaharu Yamamoto, Kyoto (JP); Kazuki Fukui, Kyoto (JP)

(73) Assignee: Dainippon Screen Mfg. Co., Ltd., Kyoto (JP)

( * ) Notice: Subject to any disclaimer, the term of this patent is extended or adjusted under 35 U.S.C. 154(b) by 0 days.

(21) Appl. No.: 10/845,118

(22) Filed: May 14, 2004

(65) Prior Publication Data

US 2004/0226469 A1 Nov. 18, 2004

(30) Foreign Application Priority Data

May 15, 2003 (JP) ..... 2003-136752
Apr. 7, 2004 (JP) ..... 2004-113016

(51) Int. Cl.[7] ..... B41F 1/66

(52) U.S. Cl. ..... 101/484; 101/147; 101/450.1; 101/485

(58) Field of Search ..... 101/484, 485, 101/147, 148, 450.1

(56) References Cited

U.S. PATENT DOCUMENTS 4,677,298 A 6/1987 Zelmanovic et al.
5,090,316 A * 2/1992 Rodi et al. ..... 101/148
5,258,925 A * 11/1993 Maier et al. ..... 382/112
5,713,286 A * 2/1998 Zorn ..... 101/450.1
5,791,249 A * 8/1998 Quadracci ..... 101/450.1
5,802,978 A * 9/1998 Geissler et al. ..... 101/484
5,826,507 A * 10/1998 Lim ..... 101/350.1
6,050,192 A * 4/2000 Kipphan et al. ..... 101/232
6,138,563 A * 10/2000 Sone et al. ..... 101/147
6,601,512 B2 * 8/2003 Yamamoto et al. ..... 101/484
6,655,272 B2 * 12/2003 Hauck et al. ..... 101/148
6,668,723 B2 * 12/2003 Berton et al. ..... 101/483
6,769,361 B2 * 8/2004 Yamamoto et al. ..... 101/350.1
6,796,227 B1 * 9/2004 Miller ..... 101/147

FOREIGN PATENT DOCUMENTS

| | | |
|---|---|---|
| EP | 1 245 388 A1 | 10/2002 |
| JP | 4-103351 | 4/1992 |
| JP | 7-266547 | 10/1995 |
| JP | 2831107 | 9/1998 |
| JP | 11-268231 | 10/1999 |
| JP | 2002-355950 | 12/2002 |

* cited by examiner

*Primary Examiner*—Charles H. Nolan, Jr.
(74) *Attorney, Agent, or Firm*—McDermott Will & Emery LLP

(57) ABSTRACT

First, densities are measured of a set of detecting patches having an equal number of lines and different area ratios between a printing area and a non-printing area, a set of detecting patches having an equal area ratio between a printing area and a non-printing area and different numbers of lines, and solid patches. Next, area ratios S relating to quantities of dampening water are calculated by using density of the set of detecting patches having the equal number of lines and different area ratios between the printing area and non-printing area, and density of the solid patches. Then, coefficients N relating to emulsification rates of ink are calculated by using density of the set of detecting patches having the equal area ratio between the printing area and non-printing area and different numbers of lines, and the density of the solid patches. Finally, a feed rate of dampening water is adjusted by using the area ratios S and coefficients N.

13 Claims, 21 Drawing Sheets

METHOD OF CONTROLLING A FEED RATE OF DAMPENING WATER IN AN OFFSET PRESS

BACKGROUND OF THE INVENTION

1. Field of the Invention

This invention relates to a method of controlling a feed rate of dampening water in an offset press.

2. Description of the Related Art

In an offset press, the feed rate of dampening water, as does the feed rate of ink, has a crucial influence on printing results. It is therefore necessary for the offset press to adjust the feed rate of dampening water properly.

To execute a method of automatically detecting the quantity of dampening water and controlling the feed rate thereof, an apparatus has been proposed that, for example, measures a film thickness of water on an ink kneading roller by using an infrared sensor or the like. However, such an apparatus presents difficulties in coping with environmental changes occurring in time of printing, and the apparatus itself is extremely expensive.

In Japanese Patent No. 2831107, a tone controlling apparatus has been proposed that detects densities of a solid portion and a halftone portion of a print, performs a comparison operation on the detected densities of the solid portion and halftone portion in relation to target densities of the solid portion and halftone portion inputted beforehand based on density variation characteristics of the solid portion and halftone portion occurring with variations in the feed rates of ink and dampening water, and simultaneously controls the feed rates of ink and dampening water based on results of the comparison operation.

Generally, an offset press has far more ink rollers for feeding ink to printing plates than water rollers for feeding dampening water to the printing plates. Thus, an adjustment of dampening water is reflected on prints in a shorter time than an adjustment of ink. Rather than adjusting dampening water and ink simultaneously as described in the above Japanese patent, it is desirable to adjust the feed rate of ink while taking influences of the water adjustment into account.

In view of the above, Applicants have proposed a method of controlling the feed rate of dampening water in Japanese Unexamined Patent Publication No. 2002-355950. This method uses first and second detecting patches that show different density variations on prints, with variations in the feed rate of dampening water, whereby the feed rate of dampening water may be adjusted properly along with the feed rate of ink.

The method of controlling dampening water described in the above Japanese Publication can properly adjust the feed rate of dampening water. However, this method does not take the emulsification of ink into account.

With progress of a printing operation by an offset press, ink undergoes changes in emulsification rate. The emulsification rate of ink means a proportion of water contained in the ink and, generally, is expressed in percentages of water content. When printing is done in an ink with a large percentage of water content, the emulsification rate of the ink exerts a significant influence on printing results, such as a larger halftone area larger than when printing is done in an ink with a proper percentage of water content. It is therefore desirable in controlling the feed rate of dampening water to take the emulsification rate of ink into account.

SUMMARY OF THE INVENTION

The object of this invention, therefore, is to provide a method of controlling the feed rate of dampening water in an offset press, which can properly adjust the feed rate of dampening water even when the emulsification rate of ink has changed.

The above object is fulfilled, according to this invention, by a method of controlling a feed rate of dampening water in an offset press, comprising:

a density measuring step for measuring densities of a plurality of detecting patches including a set of detecting patches having an equal number of lines and different area ratios between a printing area and a non-printing area, a set of detecting patches having an equal area ratio between a printing area and a non-printing area and different numbers of lines, and solid patches;

a first calculating step for calculating area ratios S relating to quantities of dampening water by using density of the set of detecting patches having the equal number of lines and different area ratios between the printing area and non-printing area, and density of said solid patches;

a second calculating step for calculating coefficients N relating to emulsification rates of ink by using density of the set of detecting patches having the equal area ratio between the printing area and non-printing area and different numbers of lines, and the density of said solid patches; and a dampening water adjusting step for adjusting the feed rate of dampening water by using said area ratios S and said coefficients N.

With the above method of controlling a feed rate of dampening water in an offset press, the feed rate of dampening water may be adjusted properly even when the emulsification rate of ink has changed.

In another aspect of the invention, a method of controlling a feed rate of dampening water in an offset press, comprises:

a density measuring step for measuring densities of a plurality of detecting patches including a set of detecting patches having an equal number of lines and different area ratios between a printing area and a non-printing area, a set of detecting patches having an equal area ratio between a printing area and a non-printing area and different numbers of lines, and solid patches;

a first calculating step for calculating area ratios S relating to quantities of dampening water by using density of the set of detecting patches having the equal number of non-printing area, and density of said solid patches;

a second calculating step for calculating coefficients N relating to emulsification rates of ink for a plurality of numbers of lines by using density of the set of detecting patches having the equal area ratio between the printing area and non-printing area and different numbers of lines, and the density of said solid patches;

a third calculating step for calculating a coefficient Z relating to a required feed rate of dampening water from the coefficients N relating to the emulsification rates of ink for the plurality of numbers of lines calculated in said second calculating step; and a dampening water adjusting step for adjusting the feed rate of dampening water by using said area ratios S and said coefficient Z.

In a further aspect of the invention, there is provided a method of controlling a feed rate of dampening water in an offset press, comprising:

a density measuring step for measuring densities of a plurality of detecting patches including a set of detecting patches having an equal number of lines and different area ratios between a printing area and a non-printing area, and solid patches;

a first calculating step for calculating area ratios S numbers of lines by using density of the set of detecting patches having the equal number of lines and different area ratios between the printing area and non-printing area, and density of said solid patches;

a fourth calculating step for calculating a coefficient Y relating to a required feed rate of dampening water from a difference between an area rate S corresponding to a large number of lines and an area rate S corresponding to a small number of lines among said area ratios S relating to quantities of dampening water; and a dampening water adjusting step for adjusting the feed rate of dampening water by using said area ratios S and said coefficient Y.

Other features and advantages of the invention will be apparent from the following detailed description of the embodiments of the invention.

BRIEF DESCRIPTION OF THE DRAWINGS

For the purpose of illustrating the invention, there are shown in the drawings several forms which are presently preferred, it being understood, however, that the invention is not limited to the precise arrangement and instrumentalities shown.

DESCRIPTION OF THE PREFERRED EMBODIMENTS

Figure 1:
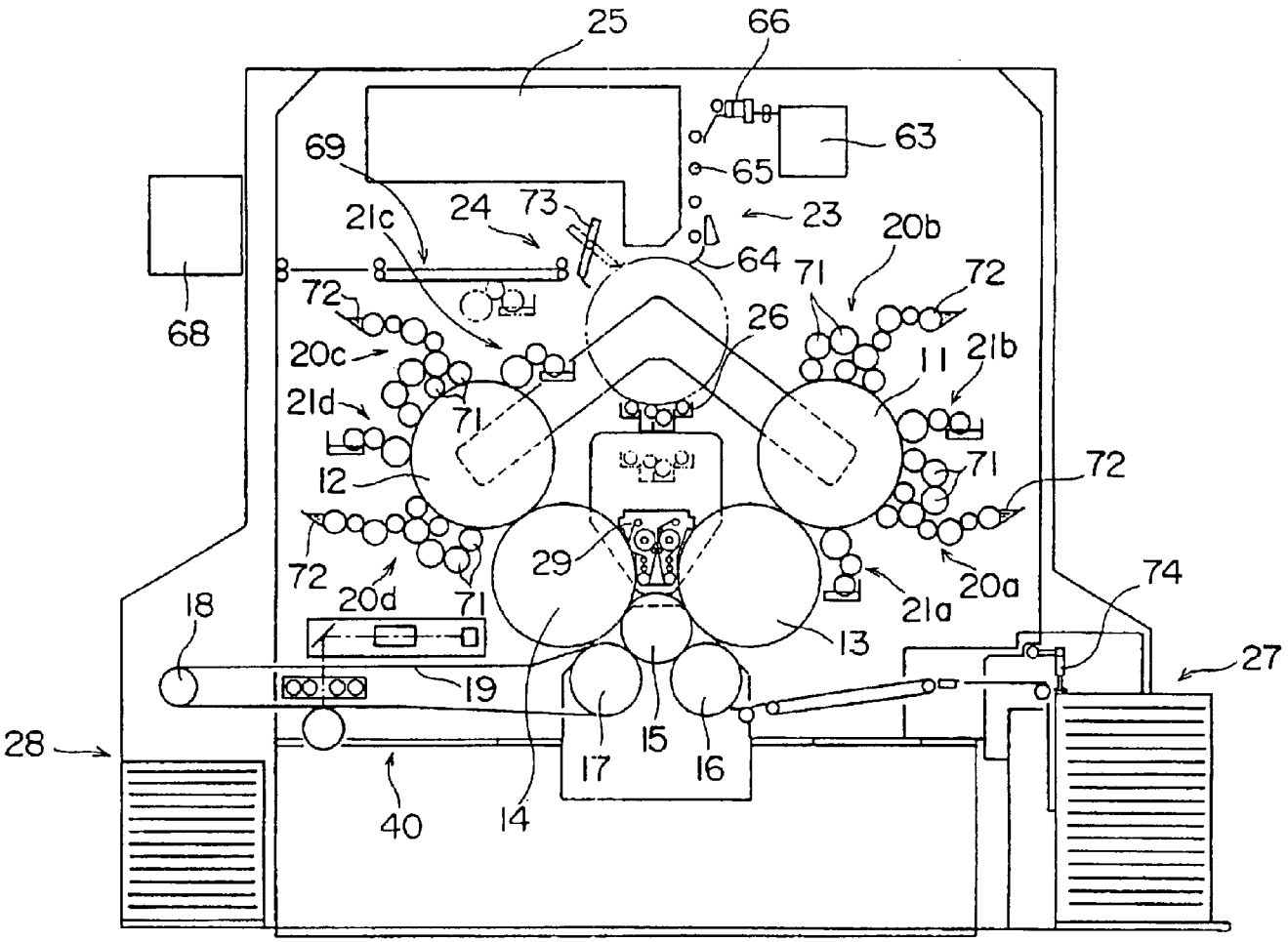
FIG. 1 is a schematic side view of an offset press to which the invention is applied.

An embodiment of this invention will be described hereinafter with reference to the drawings. An offset press will be described first, which employs the method of controlling the feed rate of dampening water according to this invention. FIG. 1 is a schematic side view of the offset press to which the invention is applied.

This offset press records images on blank plates mounted on first and second plate cylinders 11 and 12, feeds inks to the plates having the images recorded thereon, and transfers the inks from the plates through first and second blanket cylinders 13 and 14 to printing paper held on an impression cylinder 15, thereby printing the images on the printing paper.

The first plate cylinder 11 is movable between a first printing position shown in a solid line and an image recording position shown in a two-dot chain line in FIG. 1. The second plate cylinder 12 is movable between a second printing position shown in a solid line in FIG. 1 and the same image recording position.

Around the first plate cylinder 11 in the first printing position are an ink feeder 20*a* for feeding an ink of black (K), for example, to the plate, an ink feeder 20*b* for feeding an ink of magenta (M), for example, to the plate, and dampening water feeders 21*a* and 21*b* for feeding dampening water to the plate. Around the second plate cylinder 12 in the second printing position are an ink feeder 20*c* for feeding an ink of cyan (C), for example, to the plate, an ink feeder 20*d* for feeding an ink of yellow (Y), for example, to the plate, and dampening water feeders 21*c* and 21*d* for feeding dampening water to the plate. Further, around the first or second plate cylinder 11 or 12 in the image recording position are a plate feeder 23, a plate remover 24, an image recorder 25 and a developing device 26.

The first blanket cylinder 13 is contactable with the first plate cylinder 11, while the second blanket cylinder 14 is contactable with the second plate cylinder 12. The impression cylinder 15 is contactable with the first and second blanket cylinders 13 and 14 in different positions. The apparatus further includes a paper feed cylinder 16 for transferring printing paper supplied from a paper storage 27 to the impression cylinder 15, a paper discharge cylinder 17 with chains 19 wound thereon for discharging printed paper from the impression cylinder 15 to a paper discharge station 28, an image pickup station 40 for measuring densities of detecting patches printed on the printing paper, and a blanket cleaning unit 29.

Each of the first and second plate cylinders 11 and 12 is coupled to a plate cylinder moving mechanism not shown, and driven by this moving mechanism to reciprocate between the first or second printing position and the image recording position. In the first printing position, the first plate cylinder 11 is driven by a motor not shown to rotate synchronously with the first blanket cylinder 13. In the second printing position, the second plate cylinder 12 is rotatable synchronously with the second blanket cylinder 14. Adjacent the image recording position is a plate cylinder rotating mechanism, not shown, for rotating the first or second plate cylinder 11 or 12 whichever is in the image recording position.

The plate feeder 23 and plate remover 24 are arranged around the first or second plate cylinder 11 or 12 in the image recording position.

The plate feeder 23 includes a supply cassette 63 storing a roll of elongate blank plate in light-shielded state, a guide member 64 and guide rollers 65 for guiding a forward end of the plate drawn from the cassette 63 to the surface of the first or second plate cylinder 11 or 12, and a cutter 66 for cutting the elongate plate into sheet plates. Each of the first and second plate cylinders 11 and 12 has a pair of clamps, not shown, for clamping the forward and rear ends of the plate fed from the plate feeder 23.

The plate remover 24 has a blade mechanism 73 for separating a plate from the first or second plate cylinder 11 or 12 after a printing operation, a discharge cassette 68, and a conveyor mechanism 69 for transporting the plate separated by the blade mechanism 73 to the discharge cassette 68.

The forward end of the plate drawn from the feeder cassette 63 is guided by the guide rollers 65 and guide member 64, and gripped by one of the clamps on the first or second plate cylinder 11 or 12. Then, the first or second plate cylinder 11 or 12 is rotated by the plate cylinder rotating mechanism not shown, whereby the plate is wrapped around the first or second plate cylinder 11 or 12. The rear end of the plate cut by the cutter 66 is clamped by the other clamp. While, in this state, the first or second plate cylinder 11 or 12 is rotated at low speed, the image recorder 25 irradiates the surface of the plate mounted peripherally of the first or second plate cylinder 11 or 12 with a modulated laser beam for recording images thereon.

Figure 2A:
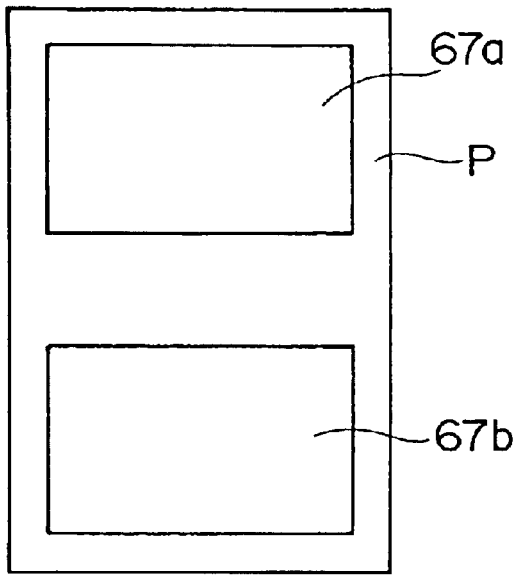
FIG. 2A is an explanatory view showing an arrangement of image areas on a printing plate.
Figure 2B:
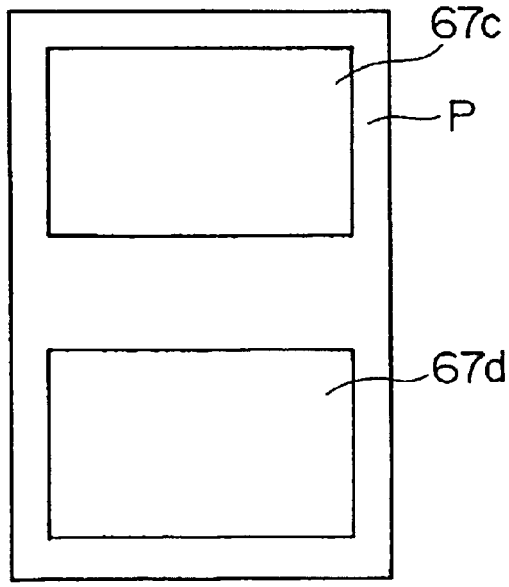
FIG. 2B is an explanatory view showing an arrangement of image areas on another printing plate.

On the plate P mounted peripherally of the first plate cylinder 11, the image recorder 25, as shown in FIG. 2A, records an image area 67*a* to be printed with black ink, and an image area 67*b* to be printed with magenta ink. On the plate P mounted peripherally of the second plate cylinder 12, the image recorder 25, as shown in FIG. 2B, records an image area 67*c* to be printed with cyan ink, and an image area 67*d* to be printed with yellow ink. The image areas 67*a* and 67*b* are recorded in evenly separated positions, i.e. in positions separated from each other by 180 degrees, on the plate P mounted peripherally of the first plate cylinder 11. Similarly, the image areas 67*c* and 67*d* are recorded in evenly separated positions, i.e. in positions separated from each other by 180 degrees, on the plate P mounted peripherally of the second plate cylinder 12.

Referring again to FIG. 1, the ink feeders 20*a* and 20*b* are arranged around the first plate cylinder 11 in the first printing position, while the ink feeders 20*c* and 20*d* are arranged around the second plate cylinder 12 in the second printing position, as described hereinbefore. Each of these ink feeders 20*a*, 20*b*, 20*c* and 20*d* (which may be referred to collectively as "ink feeders 20") includes a plurality of ink rollers 71 and an ink source 72.

The ink rollers 71 of the ink feeders 20*a* and 20*b* are swingable by action of cams or the like not shown. With the swinging movement, the ink rollers 71 of the ink feeder 20*a* or 20*b* come into contact with one of the two image areas 67*a* and 67*b* formed on the plate P mounted peripherally of the first plate cylinder 11. Thus, the ink is fed only to an intended one of the image areas 67*a* and 67*b*. Similarly, the ink rollers 71 of the ink feeders 20*c* and 20*d* are swingable by action of cams or the like not shown. With the swinging movement, the ink rollers 71 of the ink feeder 20*c* or 20*d* come into contact with one of the two image areas 67*c* and 67*d* formed on the plate P mounted peripherally of the second plate cylinder 12. Thus, the ink is fed only to an intended one of the image areas 67*c* and 67*d*.

Figure 3:
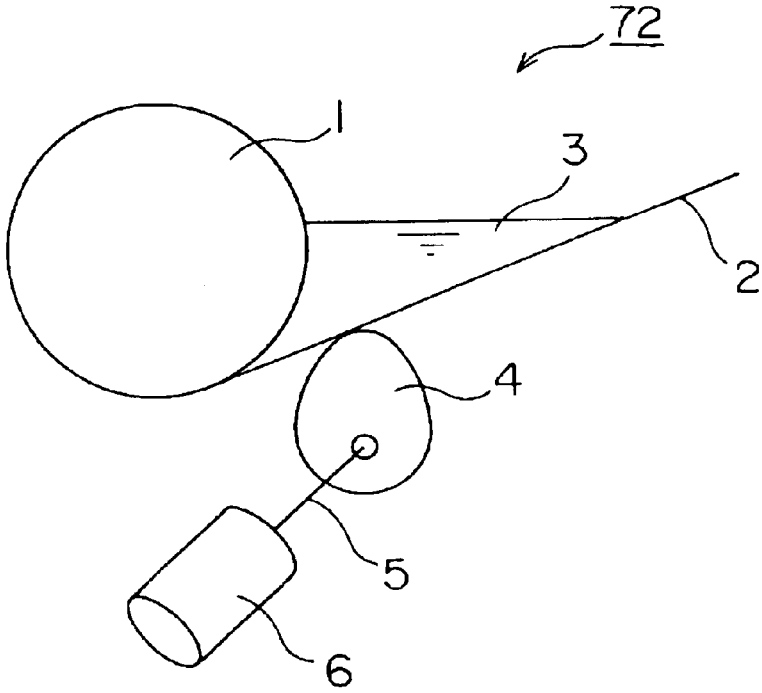
FIG. 3 is a schematic side view of an ink source.
Figure 4:
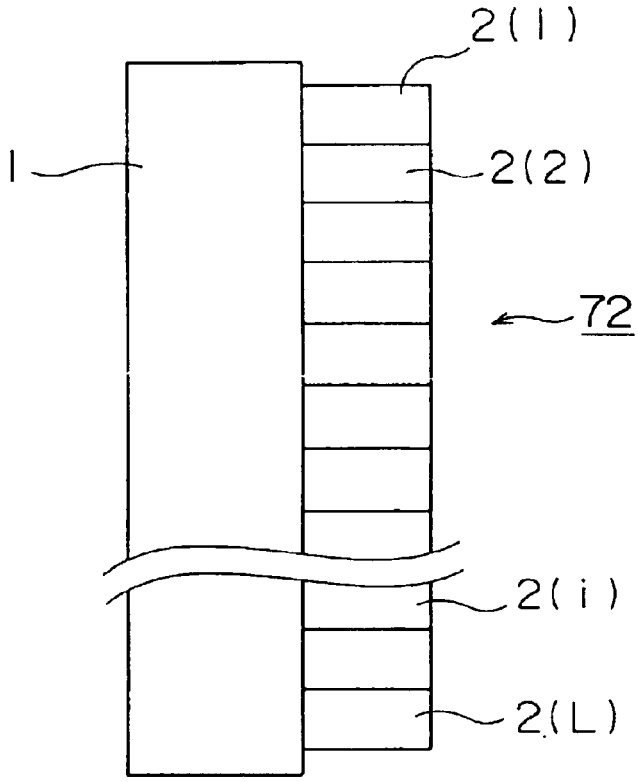
FIG. 4 is a plan view of the ink source.

FIG. 3 is a schematic side view of the ink source 72 noted above. FIG. 4 is a plan view thereof. Ink 3 is omitted from FIG. 4.

The ink source 72 includes an ink fountain roller 1 having an axis thereof extending in a direction of width of printed matter (i.e. perpendicular to a printing direction of the offset press), and ink keys 2 (1), 2 (2) . . . 2 (L) arranged in the direction of width of the printed matter. In this specification, these ink keys may be collectively called "ink keys 2 ". The ink keys 2 correspond in number to the number L of areas divided in the direction of width of the printed matter. Each of the ink keys 2 has an adjustable opening degree with respect to the outer periphery of the ink fountain roller 1. The ink fountain roller 1 and ink keys 2 define an ink well for storing ink 3.

Eccentric cams 4, L in number, are arranged under the respective ink keys 2 for pressing the ink keys 2 toward the surface of ink fountain roller 1 to vary the opening degree of each ink key 2 with respect to the ink fountain roller 1. The eccentric cams 4 are connected through shafts 5 to pulse motors 6, L in number, for rotating the eccentric cams 4, respectively.

Each pulse motor 6, in response to an ink key drive pulse applied thereto, rotates the eccentric cam 4 about the shaft 5 to vary a pressure applied to the ink key 2. The opening degree of the ink key 2 with respect to the ink fountain roller 1 is thereby varied to vary the rate of ink fed to the printing plate.

Referring again to FIG. 1, the dampening water feeders 21*a*, 21*b*, 21*c* and 21*d* (which may be referred to collectively as "dampening water feeders 21") feed dampening water to the plates P before the ink feeders 20 feed the inks thereto. Of the dampening water feeders 21, the water feeder 21*a* feeds dampening water to the image area 67*a* on the plate P, the water feeder 21*b* feeds dampening water to the image area 67*b* on the plate P, the water feeder 21*c* feeds dampening water to the image area 67*c* on the plate P, and the water feeder 21*d* feeds dampening water to the image area 67*d* on the plate P.

Figure 5:
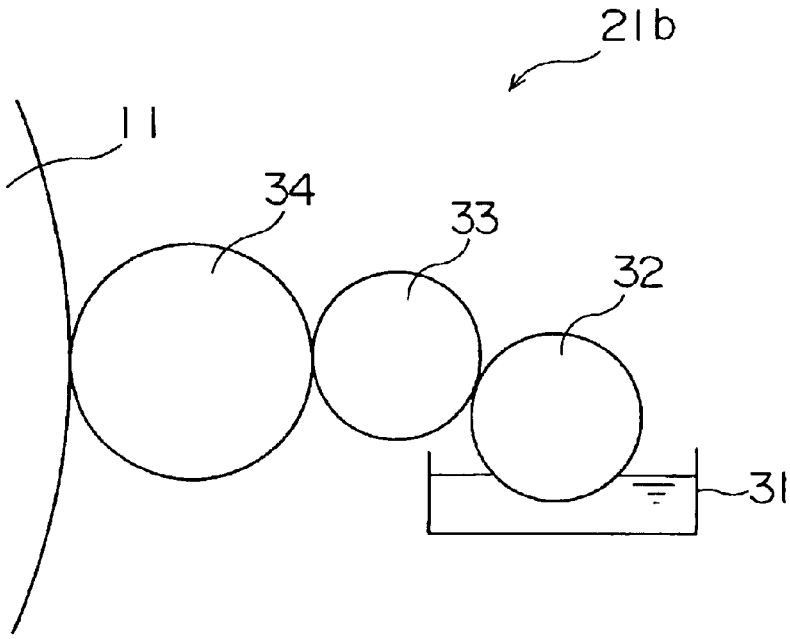
FIG. 5 is a schematic side view of a dampening water feeder.

FIG. 5 is a schematic side view of the dampening water feeder 21*b*.

The dampening water feeder 21*b* includes a water source having a water vessel 31 for storing dampening water and a water fountain roller 32 rotatable by a motor, not shown, and two water rollers 33 and 34 for transferring dampening water from the fountain roller 32 to the surface of the plate mounted peripherally of the first plate cylinder 11. This dampening water feeder is capable of adjusting the rate of feeding dampening water to the surface of the plate by varying the rotating rate of fountain roller 32.

The three other water feeders 21*a*, 21*c* and 21*d* have the same construction as the water feeder 21*b*.

Referring again to FIG. 1, the developing device 26 is disposed under the first plate cylinder 11 or second plate cylinder 12 in the image recording position. This developing device 26 includes a developing unit, a fixing unit and a squeezing unit, which are vertically movable between a standby position shown in two-dot chain lines and a developing position shown in solid lines in FIG. 1.

In developing the images recorded on the plate P by the image recorder 25, the developing unit, fixing unit and squeezing unit are successively brought into contact with the plate P rotated with the first or second plate cylinder 11 or 12.

The first and second blanket cylinders 13 and 14 movable into contact with the first and second plate cylinders 11 and 12 have the same diameter as the first and second plate cylinders 11 and 12, and have ink transfer blankets mounted peripherally thereof. Each of the first and second blanket cylinders 13 and 14 is movable into and out of contact with the first or second plate cylinder 11 or 12 and the impression cylinder 15 by a contact mechanism not shown.

The blanket cleaning unit 29 disposed between the first and second blanket cylinders 13 and 14 cleans the surfaces of the first and second blanket cylinders 13 and 14 by feeding a cleaning solution to an elongate cleaning cloth extending from a delivery roll to a take-up roll through a plurality of pressure rollers, and sliding the cleaning cloth in contact with the first and second blanket cylinders 13 and 14.

The impression cylinder 15 contactable by the first and second blanket cylinders 13 and 14 has half the diameter of the first and second plate cylinders 11 and 12 and the first and second blanket cylinders 13 and 14, as noted hereinbefore. Further, the impression cylinder 15 has a gripper, not shown, for holding and transporting the forward end of printing paper.

The paper feed cylinder 16 disposed adjacent the impression cylinder 15 has the same diameter as the impression cylinder 15. The paper feed cylinder 16 has a gripper, not shown, for holding and transporting the forward end of each sheet of printing paper fed from the paper storage 27 by a reciprocating suction board 74. When the printing paper is transferred from the feed cylinder 16 to the impression cylinder 15, the gripper of the impression cylinder 15 holds the forward end of the printing paper which has been held by the gripper of the feed cylinder 16.

The paper discharge cylinder 17 disposed adjacent the impression cylinder 15 has the same diameter as the impression cylinder 15. The discharge cylinder 17 has a pair of chains 19 wound around opposite ends thereof. The chains 19 are interconnected by coupling members, not shown, having a plurality of grippers 41 arranged thereon. When the impression cylinder 15 transfers the printing paper to the discharge cylinder 17, one of the grippers 41 of the discharge cylinder 17 holds the forward end of the printing paper having been held by the gripper of the impression cylinder 15. With movement of the chains 19, densities of the detecting patches printed on the printing paper are measured at the image pickup station 40. Thereafter the printing paper is transported to the paper discharge station 28 to be discharged thereon.

The paper feed cylinder 16 is connected to a drive motor through a belt not shown. The paper feed cylinder 16, impression cylinder 15, paper discharge cylinder 17 and the first and second blanket cylinders 13 and 14 are coupled to one another by gears mounted on end portions thereof, respectively. Further, the first and second blanket cylinders 13 and 14 are coupled to the first and second plate cylinders 11 and 12 in the first and second printing positions, respectively, by gears mounted on end portions thereof. Thus, a motor, not shown, is operable to rotate the paper feed cylinder 16, impression cylinder 15, paper discharge cylinder 17, the first and second blanket cylinders 13 and 14 and the first and second plate cylinders 11 and 12 synchronously with one another.

Figure 6:
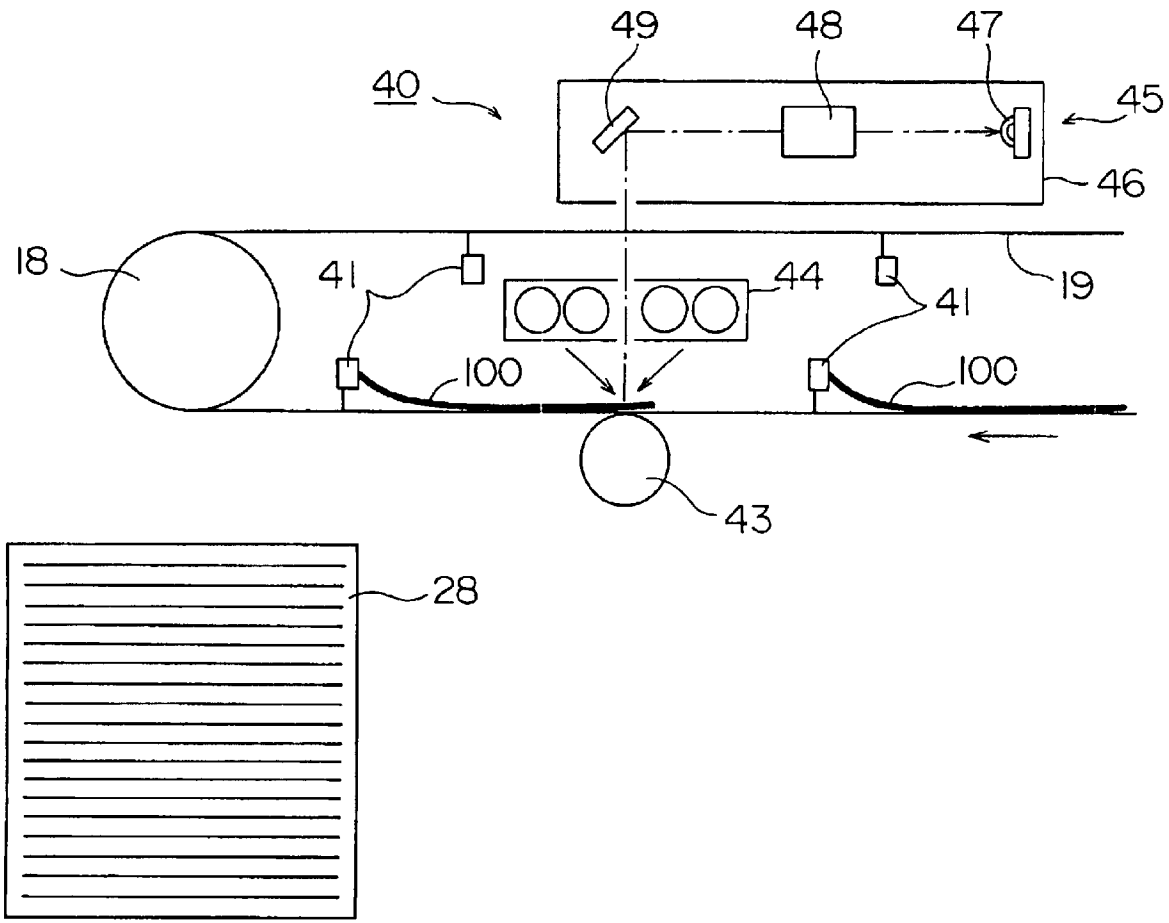
FIG. 6 is a schematic side view of an image pickup station shown with chains.

FIG. 6 is a schematic side view of the image pickup station 40 for measuring densities of the detecting patches printed on the printing paper, which is shown with the chains 19.

The pair of chains 19 are endlessly wound around the opposite ends of the paper discharge cylinder 17 shown in FIG. 1 and a pair of large sprockets 18. As noted hereinbefore, the chains 19 are interconnected by coupling members, not shown, having a plurality of grippers 41 arranged thereon each for gripping a forward end of printing paper 100 transported.

The pair of chains 19 have a length corresponding to a multiple of the circumference of paper discharge cylinder 17. The grippers 41 are arranged on the chains 19 at intervals each corresponding to the circumference of paper discharge cylinder 17. Each gripper 41 is opened and closed by a cam mechanism, not shown, synchronously with the gripper on the paper discharge cylinder 7. Thus, each gripper 41 receives printing paper 100 from the paper discharge cylinder 7, transports the printing paper 100 with rotation of the chains 19, and discharges the paper 100 to the paper discharge station 28.

The printing paper 100 is transported with only the forward end thereof held by one of the grippers 41, the rear end of printing paper 100 not being fixed. Consequently, the printing paper 100 could flap during transport, which impairs an operation, to be described hereinafter, of the image pickup station 40 to measure densities of the detecting patches. To avoid such an inconvenience, this offset press provides a suction roller 43 disposed upstream of the paper discharge station 28 for stabilizing the printing paper 100 transported.

The suction roller 43 is in the form of a hollow roller having a surface defining minute suction bores, with the hollow interior thereof connected to a vacuum pump not shown. The suction roller 43 is disposed to have an axis thereof extending parallel to the grippers 41 bridging the pair of chains 19, a top portion of the suction roller 43 being substantially at the same height as a lower run of the chains 19.

The suction roller 43 is driven to rotate or freely rotatable in a matching relationship with a moving speed of the grippers 41. Thus, the printing paper 100 is drawn to the surface of the suction roller 43, thereby being held against flapping when passing over the suction roller 43. In place of the suction roller 43, a suction plate may be used to suck the printing paper 100 two-dimensionally.

The image pickup station 40 includes an illuminating unit 44 for illuminating the printing paper 100 transported, and an image pickup unit 45 for picking up images of the detecting patches on the printing paper 100 illuminated by the illuminating unit 44 and measuring densities of the patches. The illuminating unit 44 is disposed between the upper and lower runs of chains 19 to extend along the suction roller 43, and has a plurality of linear light sources for illuminating the printing paper 100 over the suction roller 43.

The image pickup unit 45 includes a light-shielding and dustproof case 46, and a mirror 49, a lens 48 and a CCD line sensor 47 arranged inside the case 46. The image pickup unit 45 picks up the image of printing paper 100 over the suction roller 43 through slits of the illuminating unit 44. Incident light of the image reflected by the mirror 49 passes through the lens 48 to be received by the CCD line sensor 47.

Figure 7:
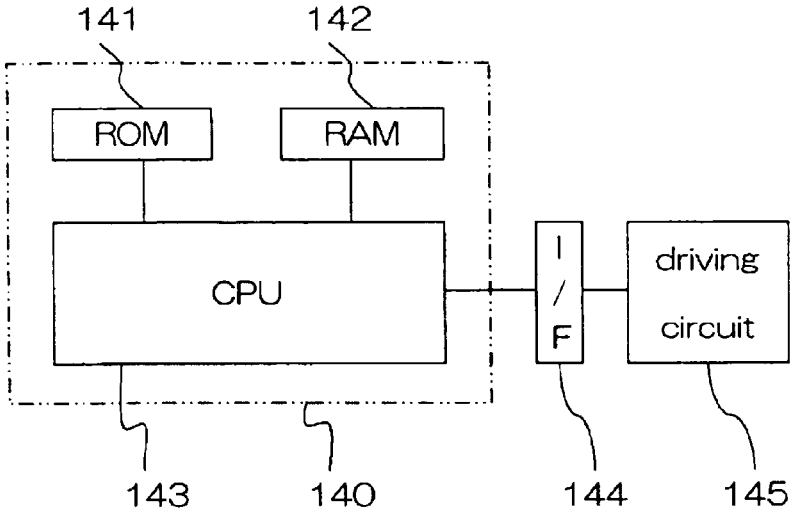
FIG. 7 is a block diagram of a principal electrical structure of the offset press.

FIG. 7 is a block diagram showing a principal electrical structure of the offset press. This offset press includes a control unit 140 having a ROM 141 for storing operating programs necessary for controlling the apparatus, a RAM 142 for temporarily storing data and the like during a control operation, and a CPU 143 for performing logic operations. The control unit 140 has a driving circuit 145 connected thereto through an interface 144, for generating driving signals for driving the ink feeders 20, dampening water feeders 21, image recorder 25, developing device 26, blanket cleaning unit 29, image pickup station 40, the contact mechanisms for the first and second blanket cylinders 13 and 14, and so on. The offset press is controlled by the control unit 140 to execute prepress and printing operations as described hereinafter.

Figure 8:
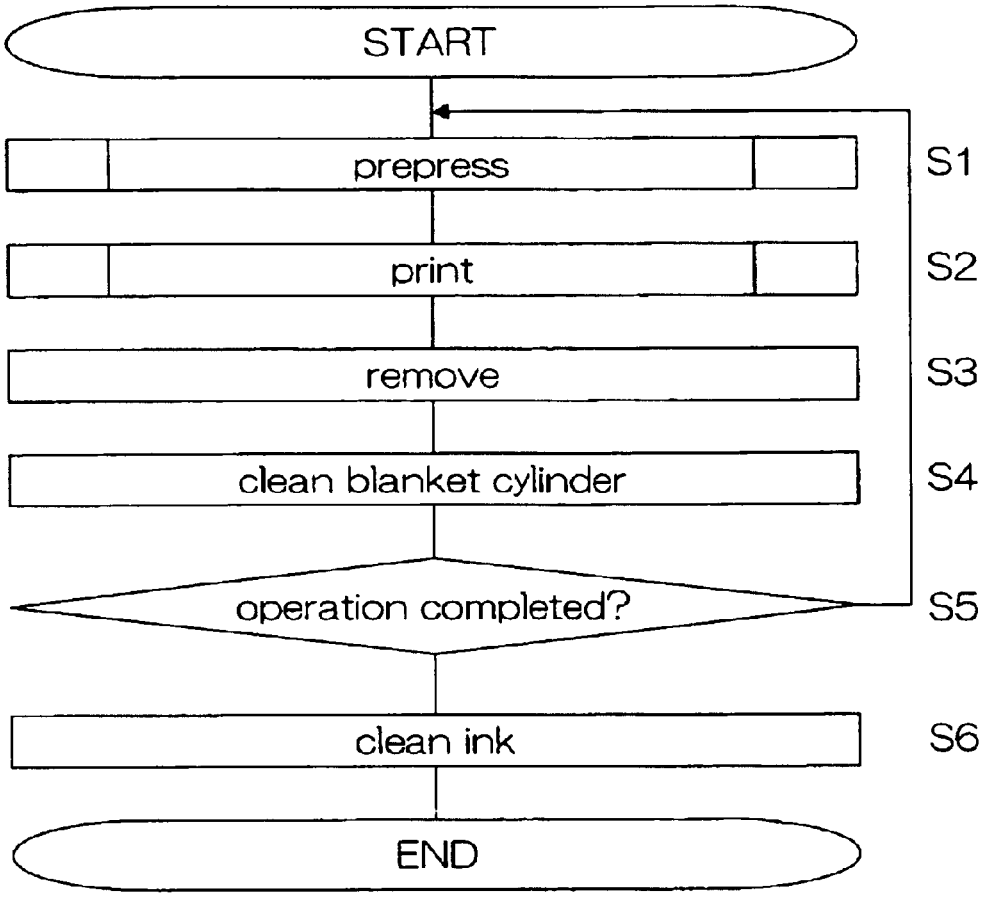
FIG. 8 is a flow chart of prepress and printing operations of the offset press.

The prepress and printing operations of the offset press will be described next. FIG. 8 is a flow chart showing an outline of the prepress and printing operations of the offset press. These prepress and printing operations are directed to multicolor printing of printing paper with the four color inks of yellow, magenta, cyan and black.

First, the offset press executes a prepress process for recording and developing images on the plates P mounted on the first and second plate cylinders 11 and 12 (step S1).

Figure 9:
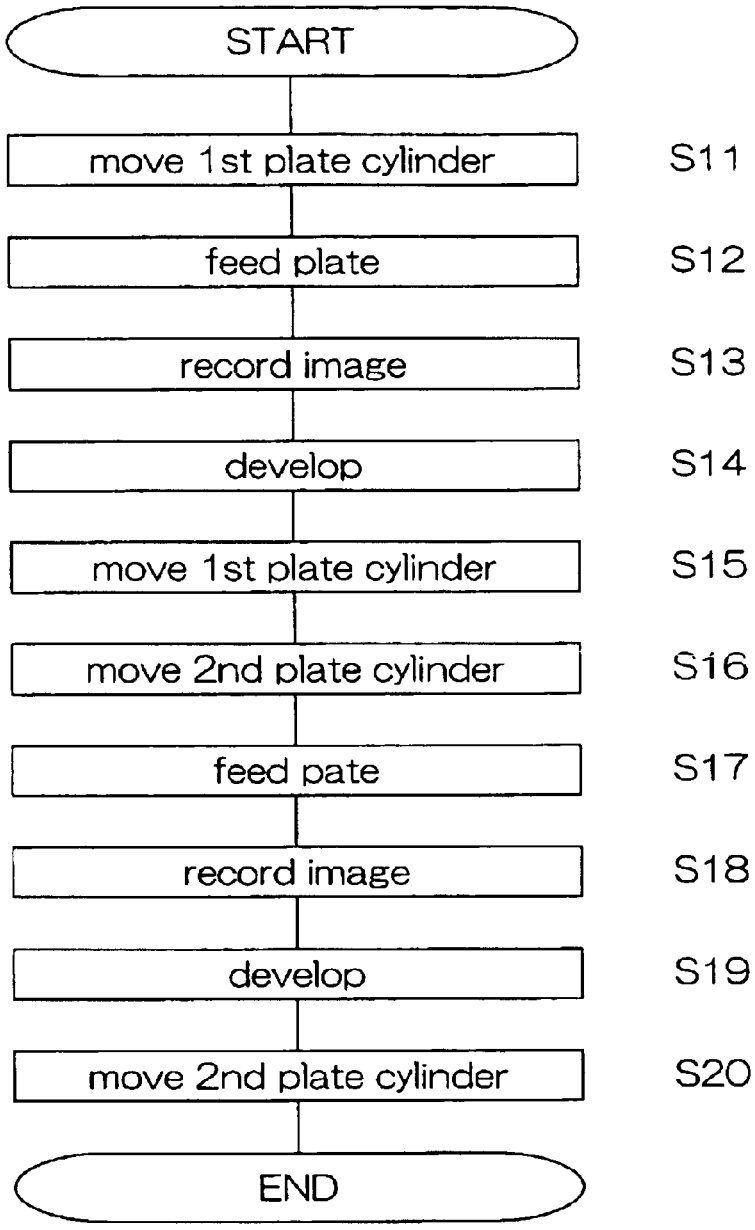
FIG. 9 is a flow chart of a prepress process.

This prepress process follows the steps constituting a subroutine as shown in the flow chart of FIG. 9.

The first plate cylinder 11 is first moved to the image recording position shown in the two-dot chain line in FIG. 1. (step S11).

Next, a plate P is fed to the outer periphery of the first plate cylinder 11 (step S12). To achieve the feeding of the plate P, the pair of clamps, not shown, clamp the forward end of plate P drawn from the supply cassette 63, and the rear end of plate P cut by the cutter 66.

Then, an image is recorded on the plate P mounted peripherally of the first plate cylinder 11 (step S13). For recording the image, the image recorder 25 irradiates the plate P mounted peripherally of the first plate cylinder 11 with a modulated laser beam while the first plate cylinder 11 is rotated at low speed.

Next, the image recorded on the plate P is developed (step S14). The developing step is executed by raising the developing device 26 from the standby position shown in two-dot chain lines to the developing position shown in solid lines in FIG. 1 and thereafter successively moving the developing unit, fixing unit and squeezing unit into contact with the plate P rotating with the first plate cylinder 11.

Upon completion of the developing step, the first plate cylinder 11 is moved to the first printing position shown in the solid line in FIG. 1 (step S15).

Subsequently, the offset press carries out an operation similar to steps S11 to S15 by way of a prepress process for the plate P mounted peripherally of the second plate cylinder 12 (steps S16 to S20). Completion of the prepress steps for the plates P mounted peripherally of the first and second plate cylinders 11 and 12 brings the prepress process to an end.

Referring again to FIG. 8, the prepress process is followed by a printing process for printing the printing paper with the plates P mounted on the first and second plate cylinders 11 and 12 (step S2). This printing process is carried out as follows.

First, each dampening water feeder 21 and each ink feeder 20 are placed in contact with only a corresponding one of the image areas on the plates P mounted on the first and second plate cylinders 11 and 12. Consequently, dampening water and inks are fed to the image areas 67*a*, 67*b*, 67*c* and 67*d* from the corresponding water feeders 21 and ink feeders 20, respectively. These inks are transferred from the plates P to the corresponding regions of the first and second blanket cylinders 13 and 14, respectively.

Then, the printing paper 100 is fed to the paper feed cylinder 16. The printing paper 100 is subsequently passed from the paper feed cylinder 16 to the impression cylinder 15. The impression cylinder 15 continues to rotate in this state. Since the impression cylinder 15 has half the diameter of the first and second plate cylinders 11 and 12 and the first and second blanket cylinders 13 and 14, the black and cyan inks are transferred to the printing paper wrapped around the impression cylinder 15 in its first rotation, and the magenta and yellow inks in its second rotation.

The forward end of the printing paper printed in the four colors is passed from the impression cylinder 15 to the paper discharge cylinder 17. This printing paper is transported by the pair of chains 19 toward the paper discharge station 28. After the densities of the detecting patches are measured at the image pickup station 40, the printing paper is discharged to the paper discharge station 28.

Upon completion of the printing process, the plates P used in the printing are removed (step S3). To remove the plates P, the first plate cylinder 11 is first moved to the image recording position shown in the two-dot chain line in FIG. 1. Then, while the first plate cylinder 11 is rotated counterclockwise, the blade mechanism 73 separates an end of the plate P from the first plate cylinder 11. The plate P separated is guided by the conveyor mechanism 69 into the discharge cassette 68. After returning the first plate cylinder 11 to the first printing position, the second plate cylinder 12 is moved from the second printing position to the image recording position to undergo an operation similar to the above, thereby having the plate P removed from the second plate cylinder 12 for discharge into the discharge cassette 68.

Upon completion of the plate removing step, the first and second blanket cylinders 13 and 14 are cleaned by the blanket cleaning unit 29 (step S4).

After completing the cleaning of the first and second blanket cylinders 13 and 14, the offset press determines whether or not a further image is to be printed (step S5). If a further printing operation is required, the apparatus repeats steps S1 to S4.

If the printing operation is ended, the offset press cleans the inks (step S6). For cleaning the inks, an ink cleaning device, not shown, provided for each ink feeder 20 removes the ink adhering to the ink rollers 71 and ink source 72 of each ink feeder 20.

With completion of the ink cleaning step, the offset press ends the entire process.

The offset press having the above construction uses detecting patches also known as control scales to control the rates of feeding ink and dampening water to the printing plates P.

Figure 10:
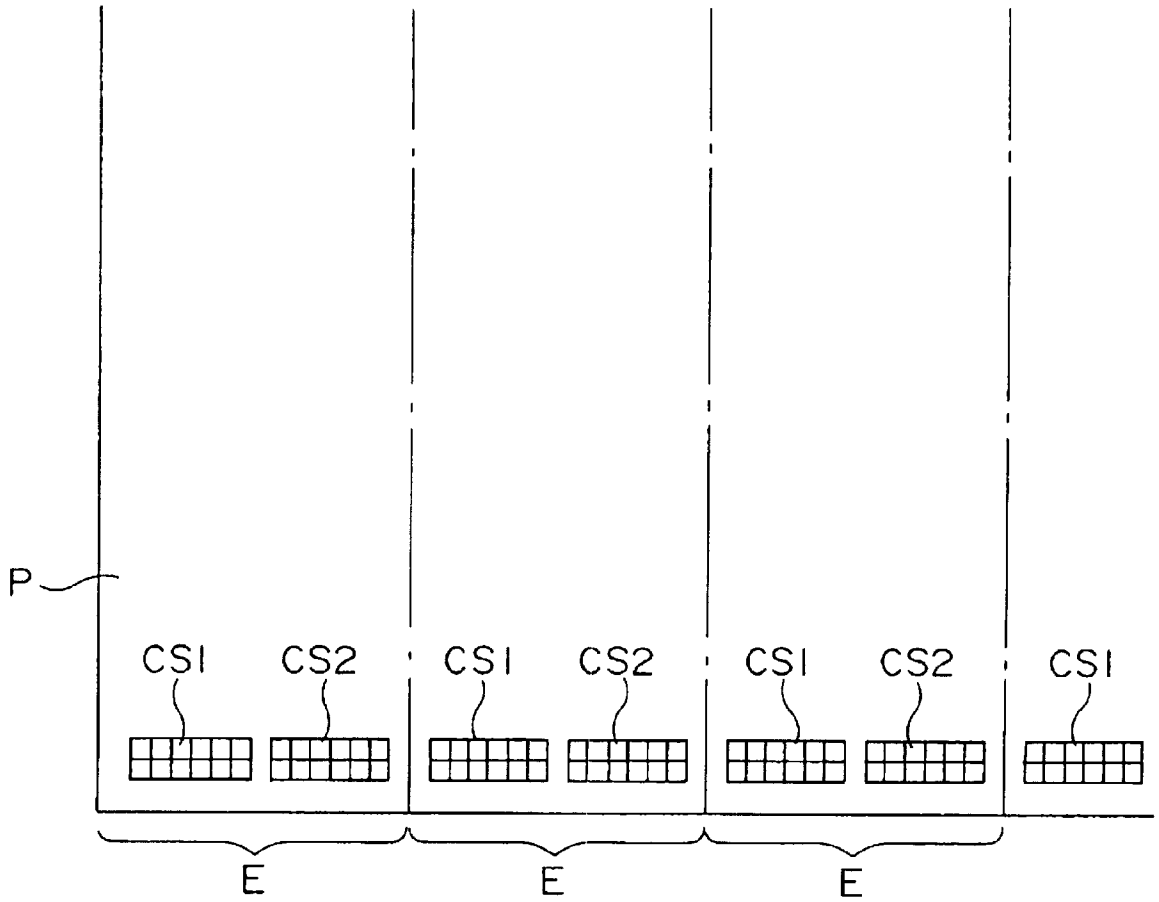
FIG. 10 is a schematic view showing control strips each including a plurality of detecting patches formed on a printing plate.

FIG. 10 is a schematic view showing control strips CS1 and CS2 each including a plurality of detecting patches formed on a printing plate P.

These control strips CS1 and CS2 are arranged in each of regions E corresponding to the ink keys 2 of the ink source 72 shown in FIGS. 3 and 4. Though not shown in FIG. 10, the control strips CS1 and CS2 are formed adjacent each of the image areas 67*a*, 67*b*, 67*c* and 67*d* of the printing plates P shown in FIGS. 2A and 2B.

Figure 11:
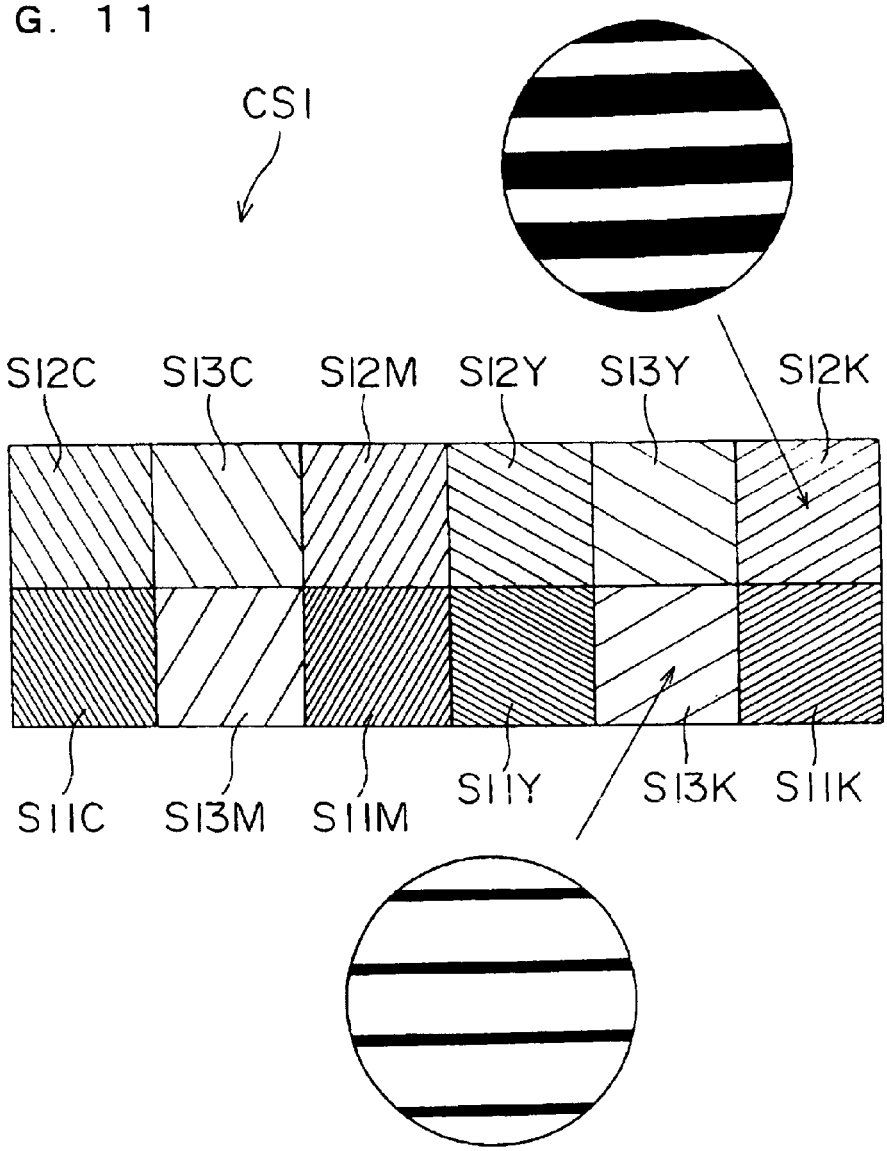
FIG. 11 is an enlarged schematic view showing a control strip.

FIG. 11 is an enlarged schematic view showing one of the control strips CS1.

This control strip CS1 includes solid patches S11 having a dot percentage at about 100%, line patches S12 with the number of lines (i.e. the number of lines per inch) at 150 and a printing area at 50% (and a non-printing area at 50%), and line patches S13 with the number of lines at 150 and a printing area at 18.8% (and a non-printing area at 81.2%).

The signs K, Y, M and C affixed to the references indicating the respective detecting patches show that these patches are for black, yellow, magenta and cyan.

Figure 12:
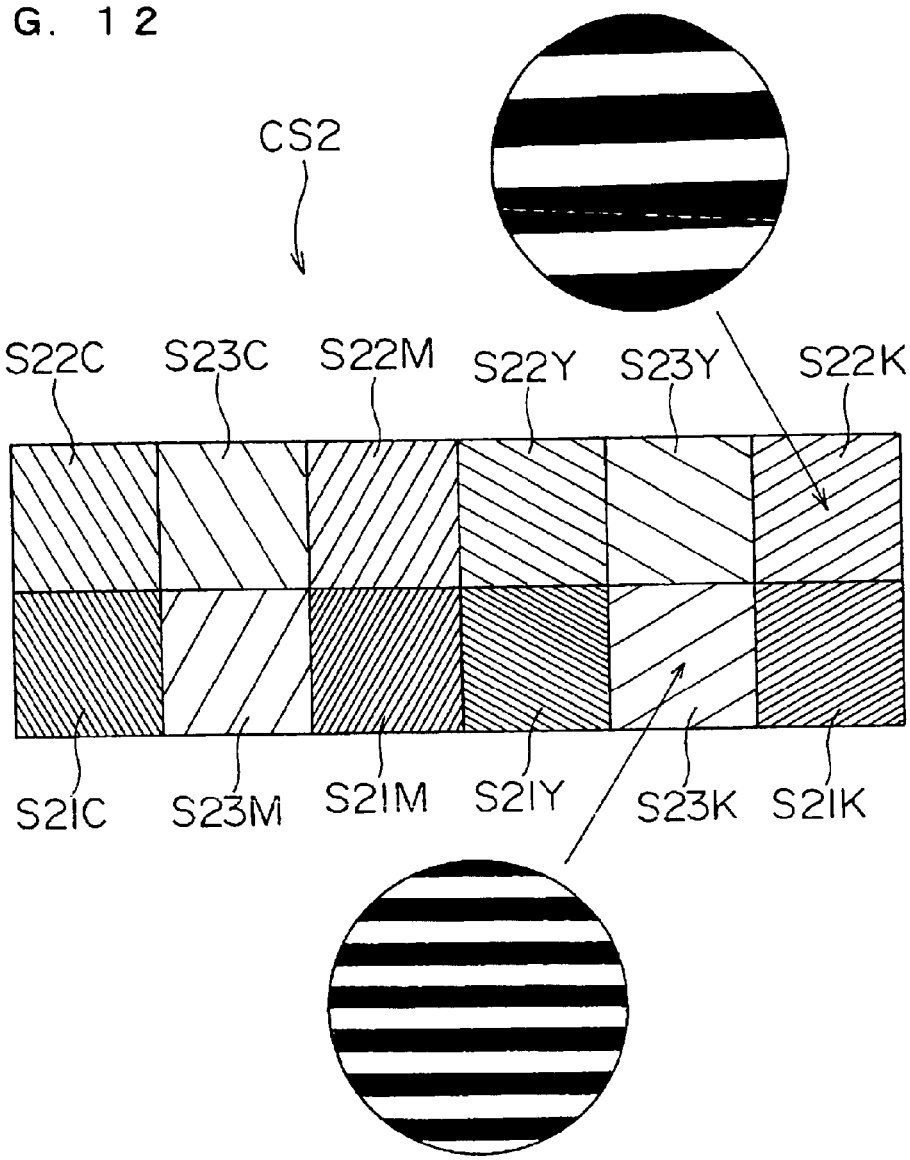
FIG. 12 is an enlarged schematic view showing a different control strip.

FIG. 12 is an enlarged schematic view showing one of the control strips CS2.

This control strip CS2 includes solid patches S21 having a dot percentage at about 100%, line patches S22 with the number of lines at 240 and a printing area at 50% (and a non-printing area at 50%), and line patches S23 with the number of lines at 120 and a printing area at 50% (and non-printing area at 50%). As in FIG. 11, the signs K, Y, M and C affixed to the references indicating the respective detecting patches show that these patches are for black, yellow, magenta and cyan.

The detecting patches S11, S12, S13, S21, S22 and S23 constituting the above control strips CS1 and CS2 are printed on the printing paper 100 in the printing operation described above. These detecting patches S11, S12, S13, S21, S22 and S23 are photographed for density measurement at the image pickup station 40.

Figure 13:
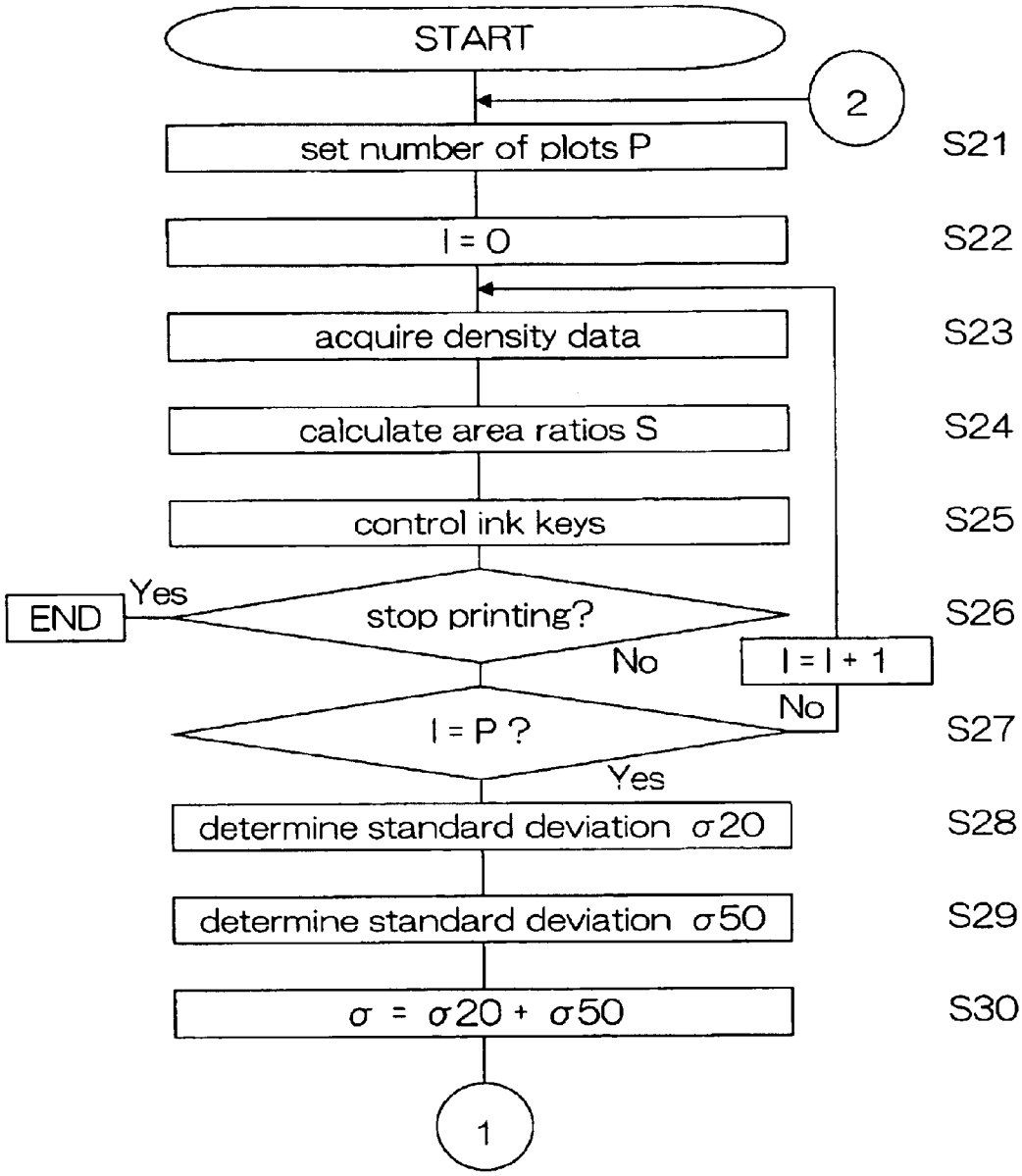
FIG. 13 is a flow chart showing an operation for controlling the feed rate of dampening water in a first embodiment of this invention.
Figure 14:
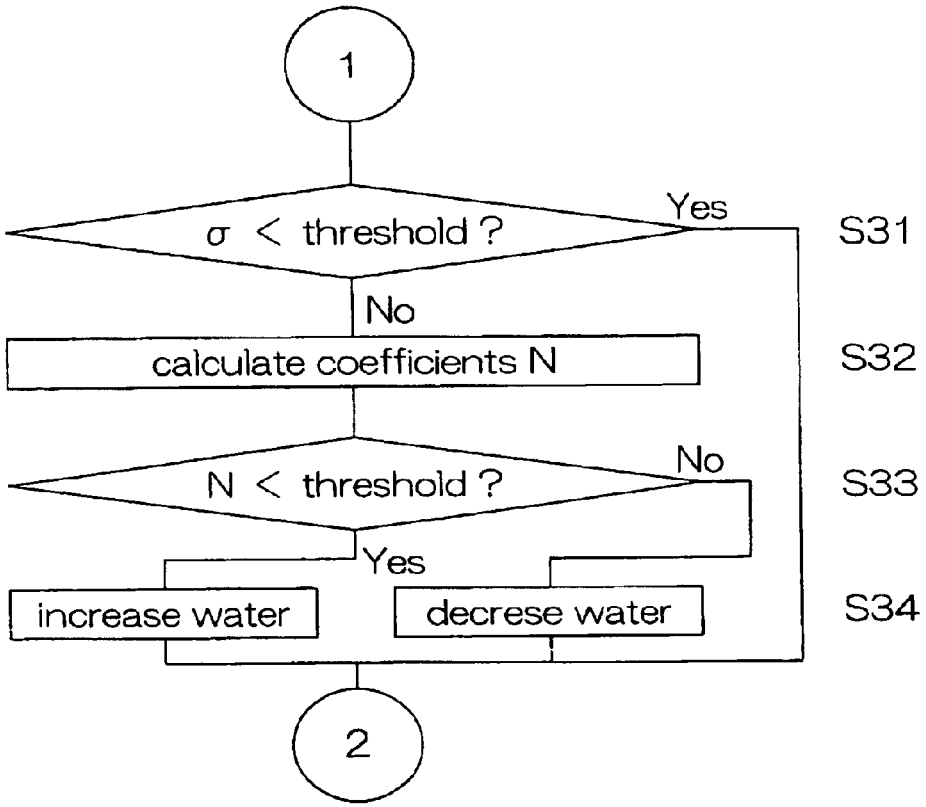
FIG. 14 is a flow chart showing the operation for controlling the feed rate of dampening water in the first embodiment.

Next, a control operation for controlling the feed rate of dampening water to be supplied to the printing plates P, by using the detecting patches S11, S12, S13, S21, S22 and S23 will be described. FIGS. 13 and 14 are flow charts showing an operation for controlling the feed rate of dampening water in a first embodiment of this invention.

First, the number of plots P for evaluating the dampening water and the like is set (step S21). The number of plots is, for example, several tens to 100 and several tens. To confirm the number of plots, I is set to 0 (step S22).

Then, density data is acquired by photographing, at the image pickup station 40, the detecting patches S11, S12, S13, S21, S22 and S23 printed on the printing paper 100 having undergone a printing operation (step S23). This density data includes density Ds of the solid patches S11 or S21 having the dot percentage at about 100%, density D50–150 of the line patches S12 with the number of lines at 150 and the printing area at 50%, density D20–150 of the line patches S13 with the number of lines at 150 and the printing area at 18.8%, density D50–240 of the line patches S22 with the number of lines at 240 and the printing area at 50%, and density D50–120 of the line patches S23 with the number of lines at 120 and the printing area at 50%. These densities Ds, D50–150, D20–150, D50–240 and D50–120 are acquired for the respective colors of Y, M, C and K.

Next, area ratios S are calculated from the following equation (1) transformed from Yule-Nielsen's relational expression:

$$S=(1-10^{(-Dm/N)})/(1-10^{(-Ds/N)}) \quad (1)$$

Specifically, the following equations (11) and (12) are obtained by substituting the above densities Ds, D50–150 and D20–150 into equation (1) above:

$$S50-150=(1-10^{(-D50-150/N-150)})/(1-10^{(-Ds/N-150)}) \quad (11)$$

$$S20-150=(1-10^{(-D20-150/N-150)})/(1-10^{(-Ds/N-150)}) \quad (12)$$

where S50–150 is an area ratio for the detecting patches S12, S20–150 is an area ratio for detecting patches S13, and N–150 is Yule-Nielsen's coefficient of an emulsification rate of ink for the 150 lines.

Area ratios S (specifically, S50–150 and S20–150) are calculated by assigning a value of coefficient N serving as reference to N–150 in the above equation.

In parallel with this, the ink keys 2 are opened and closed to control the feed rate of ink (step S25). The control of the ink keys 2 is performed by using density Ds of the solid patches S11 or S21, for example.

Then, whether the printing operation should be stopped or not is determined (step S26).

When the printing operation is continued, whether I has reached the number of plots P is checked (step S27). When I is found short of the number of plots P, 1 is added to I and steps S23 through S25 are repeated.

When I has reached the number of plots P, standard deviation σ20 is determined for area ratios S20–150 obtained from measurements and calculations so far made (step S28). Similarly, standard deviation σ50 is determined for area ratios S50–150 (step S29). A sum of σ20 and σ50 is set as a standard deviation a of the area ratios (step S30).

When calculating this standard deviation σ, the data of ink keys 2 is averaged and evaluated as a single value. However, an evaluation may be carried out for each ink key 2 to obtain standard deviations σ for all the ink keys 2.

When the value of standard deviation σ is smaller than a threshold set beforehand, it is determined that the dampening water is supplied properly and the operation returns to step S21 to repeat the foregoing steps (step S31).

When the standard deviation σ equals or exceeds the threshold, Yule-Nielsen's coefficients N are calculated (step S32). This calculation is performed by using the following Yule-Nielsen's relational expression (2):

$$Dm=-N\cdot Log\,[1-S(1-10^{(-Ds/N)})] \quad (2)$$

Data such as densities obtained from the control strips CS1 and CS2 described above is substituted into the above relational expression (2) to obtain the following equations (13), (14) and (15):

$$D50-150=-N-150\cdot \mathrm{Log}\,[1-S50-150\,(1-10^{(-Ds/N-150)})] \quad (13)$$

$$D50-120=-N-120\cdot \mathrm{Log}\,[1-S50-120\,(1-10^{(-Ds/N-120)})] \quad (14)$$

$$D50-240=-N-240\cdot \mathrm{Log}\,[1-S50-240\,(1-10^{(-Ds/N-240)})] \quad (15)$$

Figure 15:
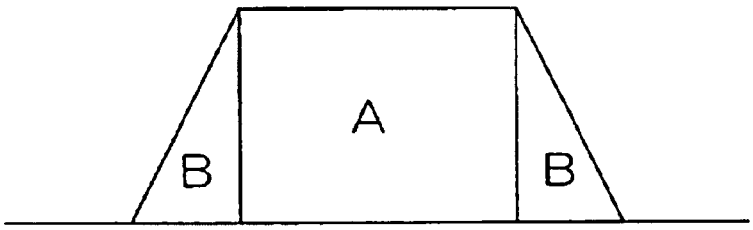
FIG. 15 is an explanatory view schematically showing a profile of ink present on printing paper.

FIG. 15 is an explanatory view schematically showing an appearance of ink present on printing paper.

In this figure, region A of the ink is unstable regardless of the quantity of dampening water. In this region A, transmittance varies with the emulsification of ink. Regions B of the ink are variable with the quantity of dampening water. The area ratio is variable with variations of these regions. The number of regions B is proportional to the number of lines. When the area ratio of 50% is S50, the value of S50 is 0.5, and therefore the following equations (16), (17) and (18) may be formed:

$$S50-150=S50+150\times\beta=0.5+150\times\beta \quad (16)$$

$$S50-120=S50+120\times\beta=0.5+120\times\beta \quad (17)$$

$$S50-240=S50+240\times\beta=0.5+240\times\beta \quad (18)$$

By substituting these equations (16), (17) and (18) into equations (13), (14) and (15) above, the following equations (19), (20) and (21) are obtained:

$$D50-150=-N-150\cdot \mathrm{Log}\,[1-(0.5+150\times\beta)\times(1-10^{(-Ds/N-150)})] \quad (19)$$

$$D50-120=-N-120\cdot \mathrm{Log}\,[1-(0.5+120\times\beta)\times(1-10^{(-Ds/N-120)})] \quad (20)$$

$$D50-240=-N-240\cdot \mathrm{Log}\,[1-(0.5+240\times\beta)\times(1-10^{(-Ds/N-240)})] \quad (21)$$

Unknown values in the above equations (19), (20) and (21) are N–150, N–120, N–240 and β. To make these values optimal, a convergence is calculated by using an optimizing method by multiple regression analysis, such as the least square method or Newton's method. Thereby Yule-Nielsen's coefficients N (specifically N–150, N–120 and N–240) can be obtained.

The values of Yule-Nielsen's coefficients N are influenced by the emulsification rate of ink. Therefore, whether Yule-Nielsen's coefficients N exceed a threshold set beforehand is determined (step S33). At this time, N–150 is used as Yule-Nielsen's coefficient N. However, N–120 or N–240 may be used instead of coefficient N–150. At this time, the data of ink keys 2 is averaged and the single coefficient N–150 is used. However, N–150 may be calculated for each ink key 2.

When the value of coefficient N–150 is smaller than the threshold, the feed rate of dampening water is increased. When the value of coefficient N–150 equals or exceeds the threshold, the feed rate of dampening water is decreased (step S34). This adjustment of the feed rate of dampening water is carried out by changing the rotating rate of the fountain roller 32 shown in FIG. 5.

When the adjustment of the feed rate of dampening water is completed, the operation returns to step S21 to repeat the foregoing steps.

Yule-Nielsen's coefficient N calculated in step S32 is variable with the type of printing paper 100 and the type of ink. It is therefore desirable to store values of coefficient N in memory periodically. Thus, for each type of printing paper 100 and ink, a value of Yule-Nielsen's coefficient N is stored in a lookup table or the like whenever the operator determines that proper printing is performed. The value of coefficient N stored is used when printing on the same type of printing paper 100 and in the same type of ink next time. The value of coefficient N stored in this way may be used as the reference noted hereinbefore.

Instead of storing values of coefficient N based on a determination made by the operator, values of the coefficient N may be stored automatically, for example, when the values of coefficient N are stabilized. The values of coefficient N stored based on the operator determination or stored automatically may be averaged or weighted and set as a new value of coefficient N.

Figure 16:
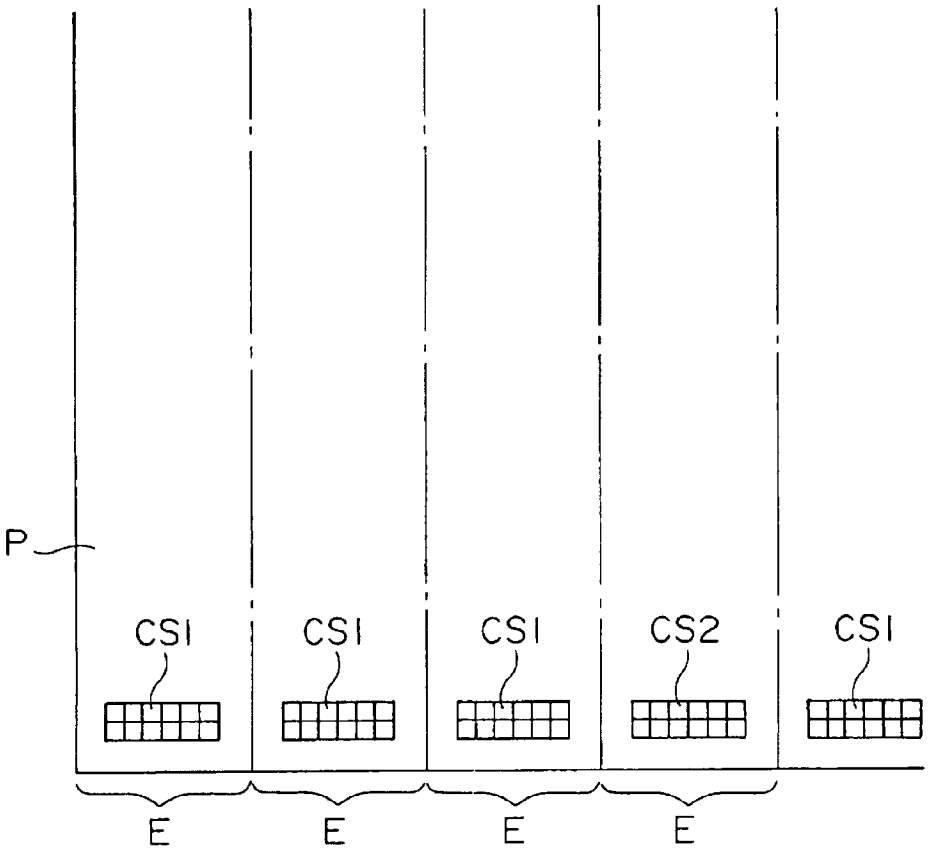
FIG. 16 is a schematic view showing control strips each including a plurality of detecting patches formed on a printing plate.

In the embodiment described above, as shown in FIG. 10, both control strips CS1 and CS2 are arranged in regions E corresponding to the ink keys 2 of each ink source 72. However, as shown in FIG. 16, only one of the control strips CS1 and CS2 may be arranged in the regions E corresponding to the ink keys 2. In this case, as shown in FIG. 16, the control strips CS2 may be fewer than the control strips CS1 used for detecting the emulsification of ink. Further, the control strips CS1 and CS2 may be arranged only in certain of the regions E corresponding to the ink keys 2.

In the embodiment described above, the solid patches S11 and solid patches S12 are arranged in both the control strips CS1 and control strips CS2. Instead, the solid patches S11 or solid patches S12 may be omitted.

In the embodiment described above, each control strip CS1 includes solid patches S11 having a dot percentage at about 100%, line patches S12 with the number of lines at 150 and a printing area at 50%, and line patches S13 with the number of lines at 150 and a printing area at 18.8%. Each control strip CS2 includes solid patches S21 having a dot percentage at about 100%, line patches S22 with the number of lines at 240 and a printing area at 50%, and line patches S23 with the number of lines at 120 and a printing area at 50%. However, the line patches S12 and S23 may be combined.

Specifically, the invention may be implemented by using four types of detecting patches including solid patches having a dot percentage at about 100%, line patches with the number of lines at 150 and a printing area at 50%, and line patches with the number of lines at 150 and a printing area at 18.8%, and line patches with the number of lines at 300 and a printing area at 50%. In short, the invention may use any combination of detecting patches as long as this provides a pair of line patches with the same number of lines and different area ratios, and a pair of detecting patches with the same area ratio and different numbers of lines.

Figure 17:
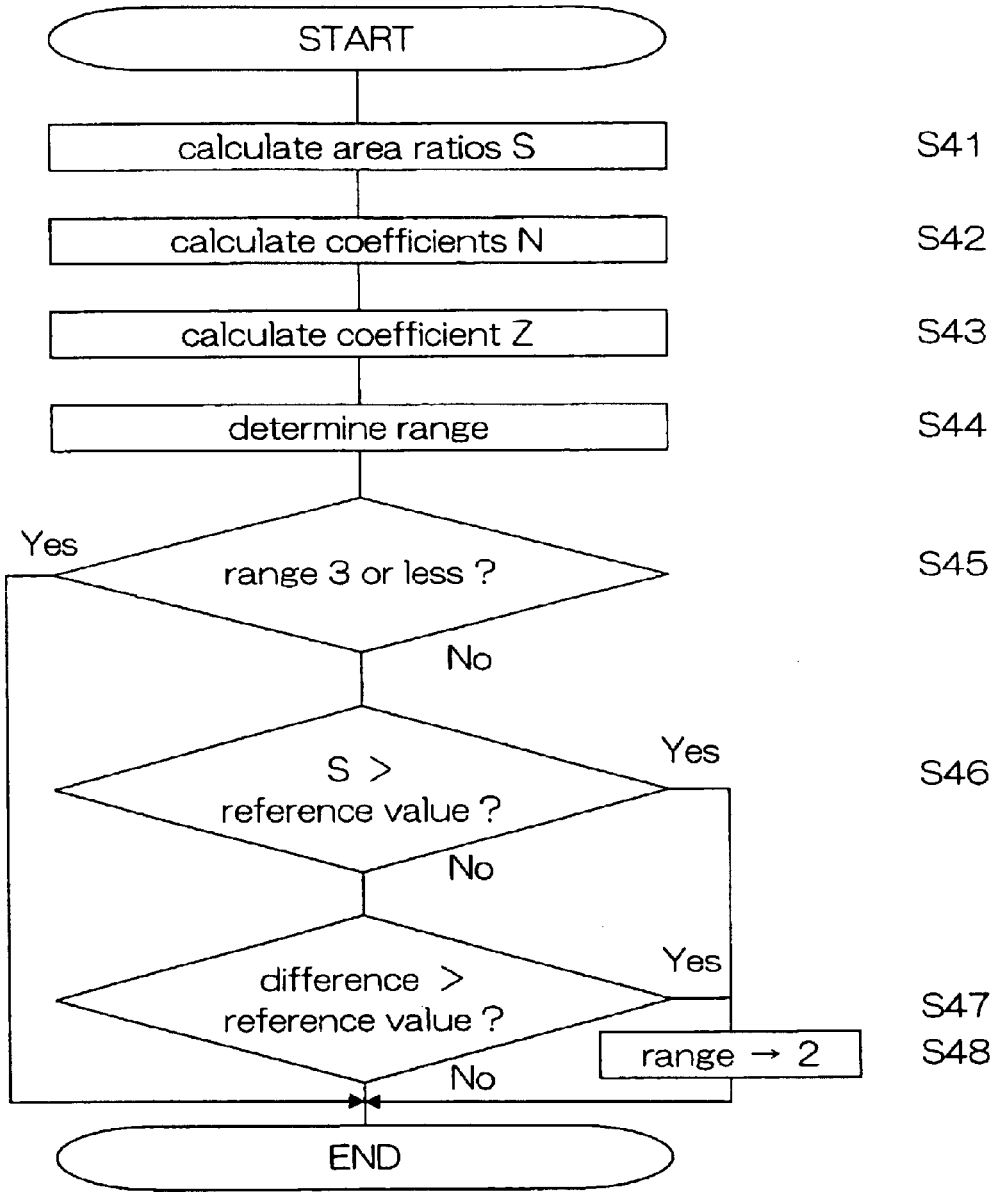
FIG. 17 is a flow chart showing a range determining operation.
Figure 18:
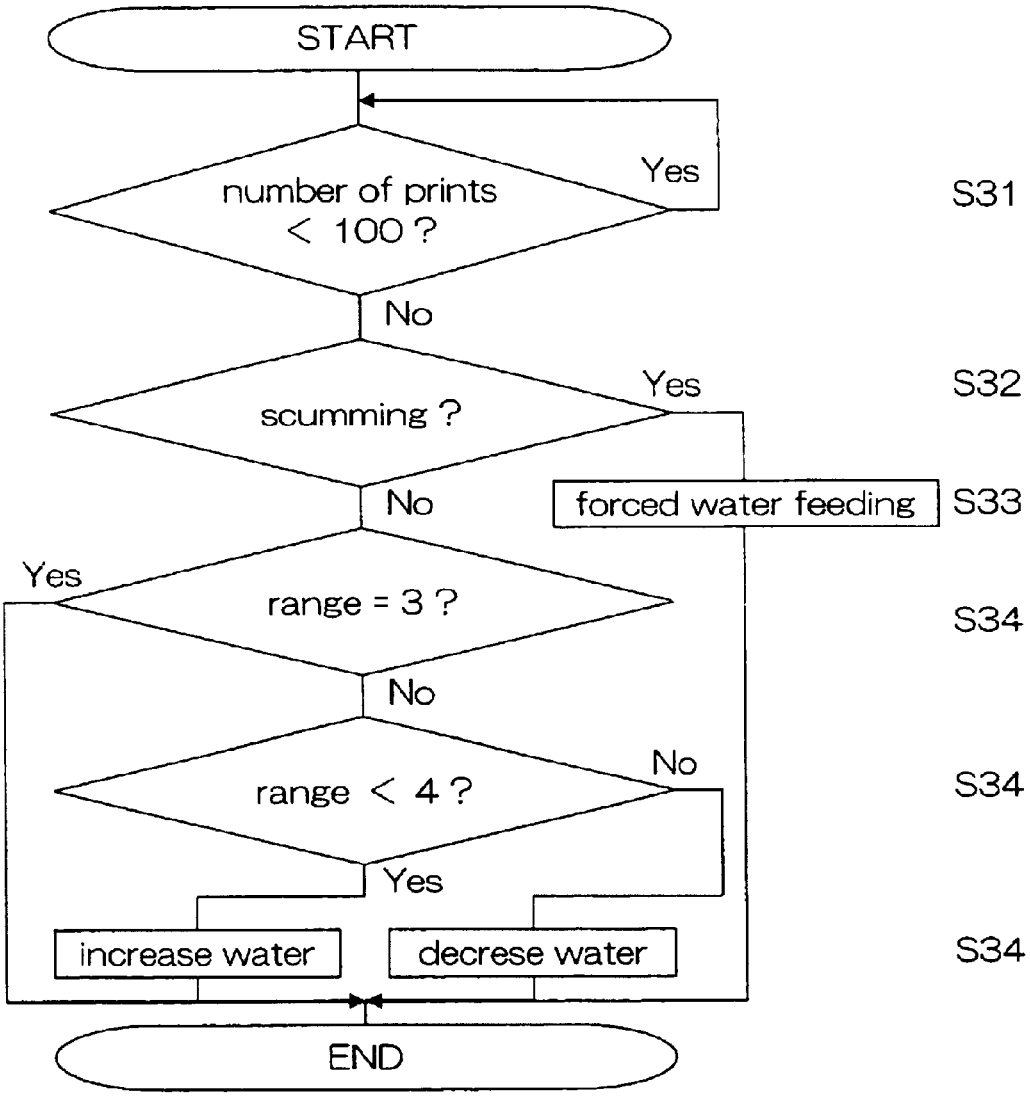
FIG. 18 is a flow chart showing a water feeding operation.

A second embodiment of this invention will be described next. FIG. 17 is a flow chart showing a range determining operation in the method of controlling the feed rate of dampening water in the offset press in the second embodiment of this invention. FIG. 18 is a flow chart showing a water feeding operation performed after determining a range.

In the first embodiment described above, Yule-Nielsen's coefficient N is calculated and the feed rate of dampening water is adjusted when standard deviation σ of the area ratio exceeds the threshold set beforehand. In the second embodiment, coefficient Z relating to a required feed rate of dampening water is calculated from Yule-Nielsen's coefficient N, a range to which the value of coefficient Z derived belongs is determined, and thereafter the range determined is changed by using area ratio S.

That is, in the method of controlling the feed rate of dampening water in the offset press in the second embodiment, area ratios S and Yule-Nielsen's coefficients N are calculated first (steps S41 and S42). The area ratios S and Yule-Nielsen's coefficients N (specifically N-120, N-150 and N-240) are calculated in the same process as in the first embodiment described above.

Next, coefficient Z relating to a required feed rate of dampening water is calculated from coefficients N-120, N-150 and N-240 (step S43). Coefficient Z is calculated based on a phenomenon that, in time of a high feed rate of dampening water, Yule-Nielsen's coefficient N corresponding to a small number of lines has an increased value, and that corresponding to a large number of lines has a decreased value.

Figure 19:
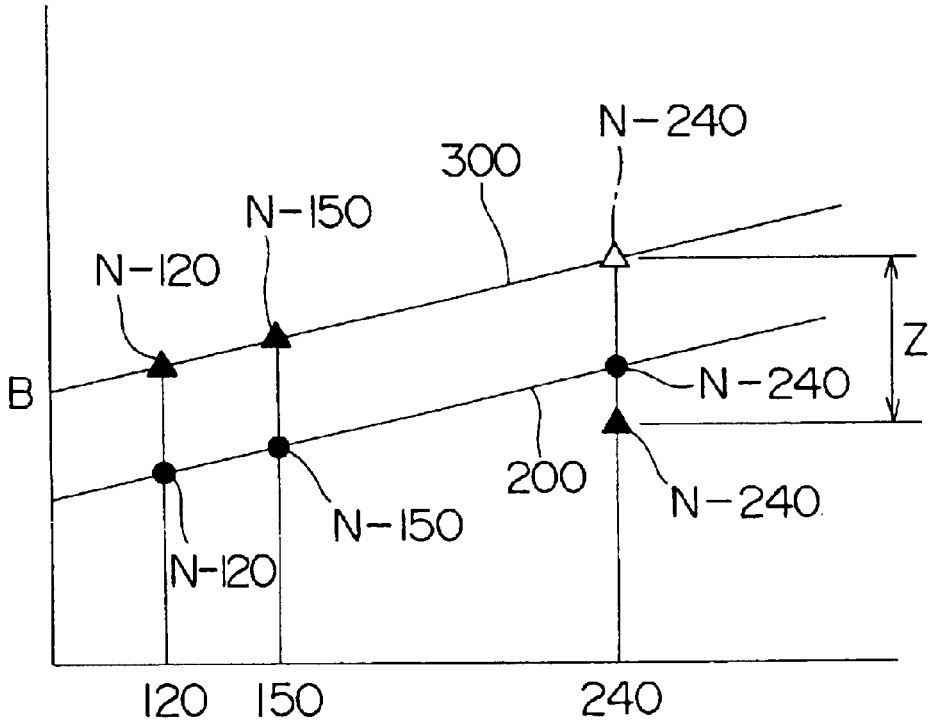
FIG. 19 is an explanatory view showing a relationship between Yule-Nielsen's coefficient N and the number of lines.

FIG. 19 is an explanatory view showing a relationship between Yule-Nielsen's coefficient N and the number of lines. In FIG. 19, the horizontal axis represents the number of lines, and the vertical axis Yule-Nielsen's coefficient N.

Generally, coefficient N and the number of lines are N-120, N-150 and N-240 are arranged on a straight line 200 in FIG. 19, for example. When the feed rate of dampening water increases from this state, N-120, N-150 and N-240 should, theoretically, be arranged on a straight line 300 in FIG. 19, for example. In practice, however, only N-240 among N-120, N-150 and N-240 takes a value smaller than an expected value by Z. This is set as the value of coefficient Z. Coefficient Z is derived from the following equations based on a combination of coefficients N-120, N-150 and N–240:

$$A=([N-150]-[N-120])/30$$

$$B=[N-120]-120*A$$

$$Z=240*A+B-[N-240]$$

where A is the inclination of straight line 300 shown in FIG. 19, and B is an intercept.

Next, a range of coefficient Z (or a range to which coefficient Z belongs) is determined (step S44).

Specifically, six ranges from 0 to 5 for the value of Z are set beforehand. Of the six ranges, range 0 is where scumming occurs regardless of the value of coefficient Z, thus requiring a great increase in the feed rate of dampening water. In this event, this embodiment temporarily and forcibly supplies a large quantity of water. Such forcible supply of water is disclosed in Japanese Unexamined Patent Publication No. 2003-334930, for example. Range 1 is for a small value of coefficient Z, which requires a substantial increase in the feed rate of dampening water. Range 2 is for a next small value of coefficient Z, which requires an increase in the feed rate of dampening water. Range 3 is for a medial value of coefficient Z, which does not require a change in the feed rate of dampening water. Range 4 is for a slightly large value of coefficient Z, which requires a decrease in the feed rate of dampening water. Range 5 is for a large value of coefficient Z, and requires a substantial decrease in the feed rate of dampening water. A relationship between coefficient Z and these ranges is determined based on an empirical measurement beforehand.

When the value of coefficient Z calculated belongs to range 3 or lower range, the operation is terminated in favor of the water feeding operation described hereinafter (step S45).

When the value of coefficient Z calculated belongs to range 4 or higher range, area ratio S50–150 calculated previously is compared with a reference value set beforehand (step S46). When this value of area ratio S50–150 is larger than the reference value, the dampening water is determined insufficient. Z is determined to belong to range 2 regardless of its value (step S48), and the operation is terminated in favor of the water feeding operation described hereinafter.

When the value of area ratio S50–150 is smaller than the reference value, the value of area ratio S50–150 in the region E arranged adjacent the middle, among the regions E corresponding to the ink keys 2 shown in FIG. 10 or 16, is compared with the values of area ratio S50–150 in the regions E arranged at opposite ends (step S47). The value of area ratio S50–150 in each of the regions E arranged at the opposite ends is subtracted from the value of area ratio S50–150 in the region E arranged adjacent the middle. When even one of the resulting differences is smaller than a reference value set beforehand, Z is determined to belong to range 2 regardless of its value (step S48), and the operation is terminated in favor of the water feeding operation described hereinafter. When both of the differences are smaller than the reference value, the operation is then terminated in favor of the water feeding operation described hereinafter.

The differences between the value of area ratio S50–150 in the region E arranged adjacent the middle and the values of area ratio S50–150 arranged at the opposite ends are used for the following reasons. Bending of the water rollers 33 and 34 shown in FIG. 5 tends to increase the feed rate of dampening water to regions E arranged adjacent the middle, and to increase the possibility of fill-ins in regions E arranged toward the opposite ends. Thus, the values of area ratio S50–150 arranged at the opposite ends are subtracted from the value of area ratio S50–150 in the region E arranged adjacent the middle, and the dampening water may be determined insufficient when the differences obtained exceed the reference value.

While area ratio S50–150 is used in steps S46 and S47 described above, area ratio S20–150 may be used instead of area ratio S50–150.

After a range of coefficient Z is determined by the above process, the water feeding operation shown in FIG. 18 is carried out.

First, it is determined whether the number of prints has exceeded 100 (step S51). When the number of prints is less than 100, the printing condition is not stable yet, and the feed rate of dampening water is not adjusted.

When the number of prints is found to exceed 100, a presence or absence of scumming is determined from images of the printing paper 100 photographed at the image pickup portion 40 after a printing operation (step S52). This determination is effected by measuring the density of non-print regions on the printing paper 100, and checking whether the non-print regions are inked. When scumming is determined present, a forced water feeding operation is carried out to feed a large quantity of dampening water temporarily, and thereafter reinstate the earlier feed rate of dampening water (step S53). The occurrence of scumming and the forced water feeding operation are disclosed in Japanese Unexamined Patent Publication No. 2003-334930 noted hereinbefore.

Next, whether coefficient Z belongs to range 3 is determined (step S54). When coefficient Z belongs to range 3, it is determined that the feed rate of dampening water is proper, and the operation is terminated.

When coefficient Z does not belong to range 3, whether the range of coefficient Z is lower than range 4 (that is, range 2 or less) is determined (step S55). When the range of coefficient Z is lower than range 4 (that is, range 2 or less), the feed rate of dampening water is increased. When the range of coefficient Z belongs to range 4 or higher, the feed rate of dampening water is decreased (step S56). At this time, the extent of increase or decrease in the feed rate of dampening water is adjusted according to the range of coefficient Z.

Figure 20:
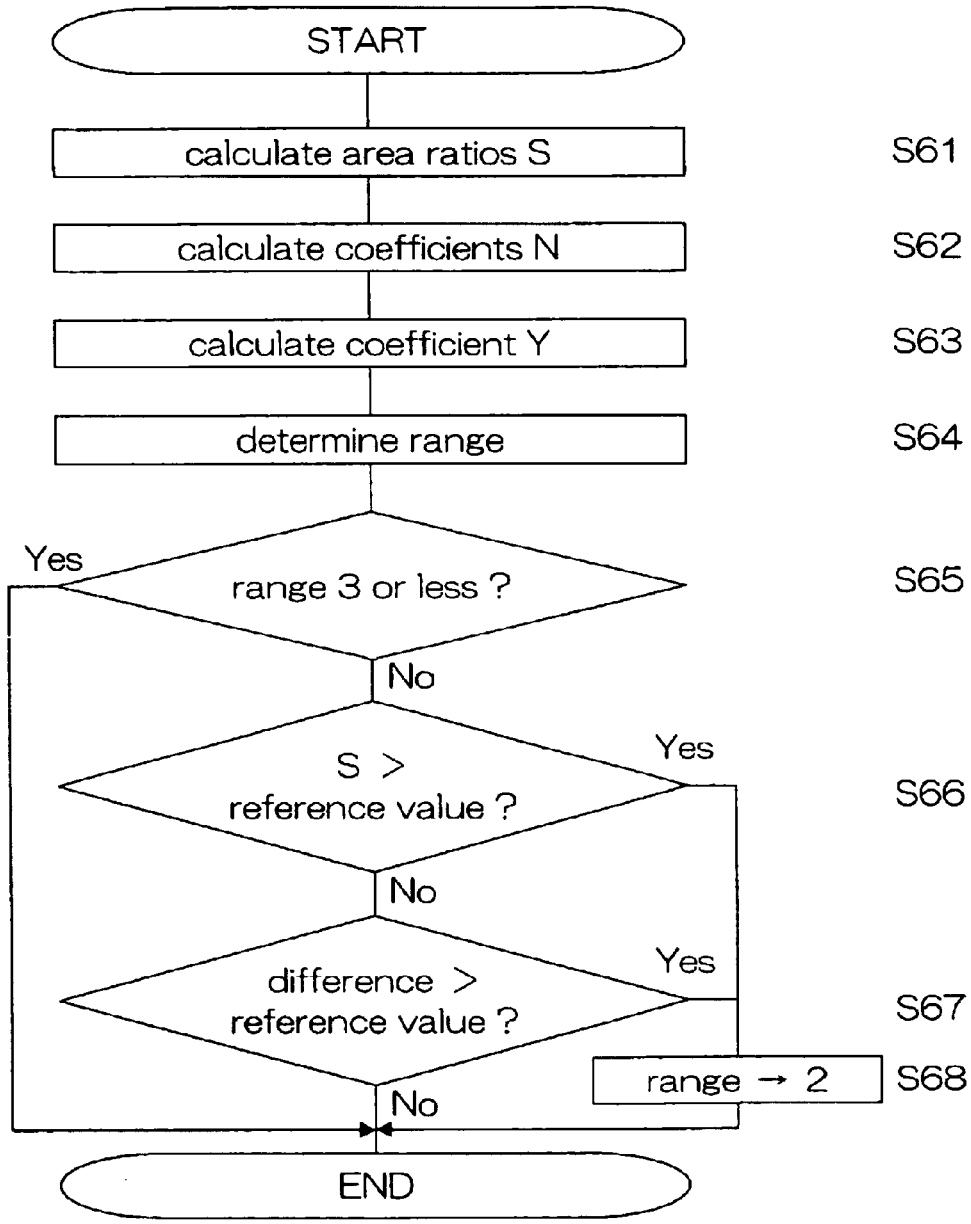
FIG. 20 is a flow chart showing a range determining operation.

A third embodiment of this invention will be described next. FIG. 20 is a flow chart showing a range determining operation in the method of controlling the feed rate of dampening water in the offset press in the third embodiment of this invention.

In the second embodiment described above, coefficient Z relating to a required feed rate of dampening water is calculated from Yule-Nielsen's coefficient N, a range to which the value of coefficient Z derived belongs is determined, and thereafter the range determined is changed by using area ratio S. In the third embodiment, coefficient Y relating to a required feed rate of dampening water is calculated from a difference between area ratio S corresponding to a large number of lines and area ratio S corresponding to a small number of lines, a range to which the value of coefficient Y derived belongs is determined, and thereafter the range determined is changed by using area ratios S.

That is, in the method of controlling the feed rate of dampening water in the offset press in the third embodiment, area ratios S and Yule-Nielsen's coefficients N are calculated first (steps S61 and S62). The area ratios S and Yule-Nielsen's coefficients N (specifically N-120, N–150 and N–240) are calculated in the same process as in the first and second embodiments described above.

Next, coefficient Y relating to a required feed rate of dampening water is calculated from coefficients N-120, N-150 and N-240 (step S63). Coefficient Y is calculated based on a phenomenon that, in time of a high feed rate of dampening water, the value of area ratio S corresponding to a small number of lines tends to decrease, and that corresponding to a large number of lines tends to increase.

Figure 21:
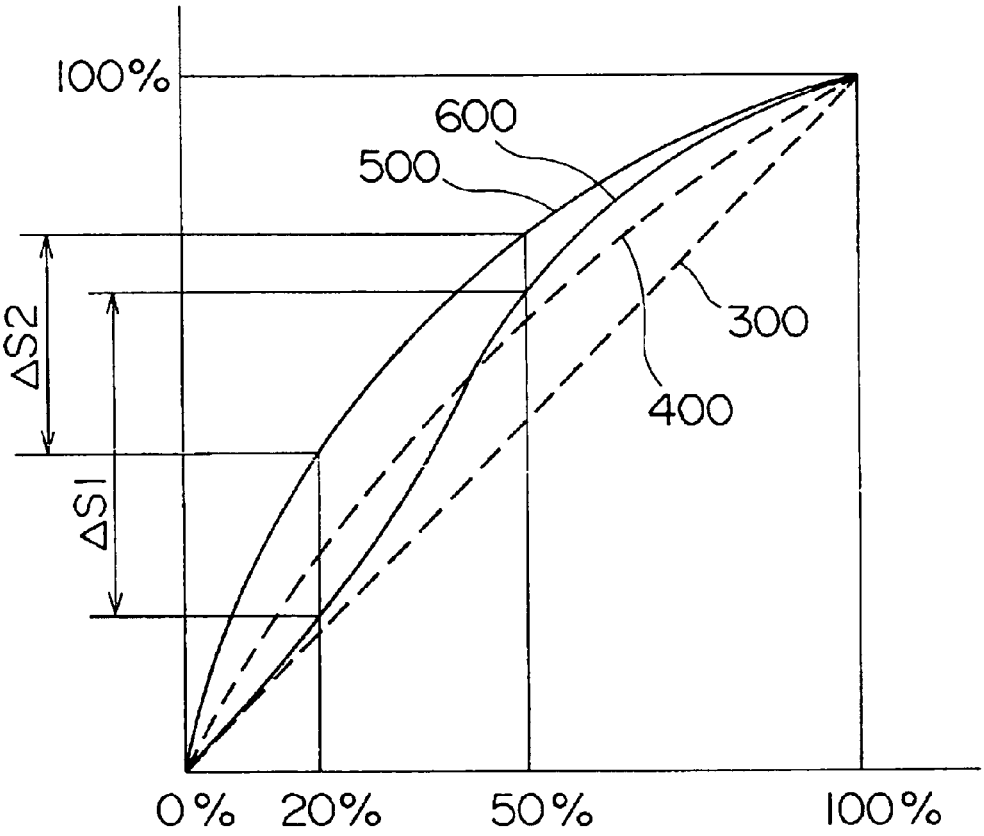
FIG. 21 is an explanatory view showing a relationship between theoretical area ratio and actual area ratio.

FIG. 21 is an explanatory view showing a relationship between theoretical area ratio and actual area ratio. In FIG. 21, the horizontal axis represents theoretical area ratio, and the vertical axis actual area ratio.

Essentially, the relationship between theoretical area ratio and actual area ratio when recording an image describes a straight line 300 shown in FIG. 21. With a dot gain occurring in time of printing taken into account, the relationship between theoretical area ratio and actual area ratio describes an arcuate curve 400 in FIG. 21. In practice, however, when dampening water is supplied at a low feed rate, the relationship between theoretical area ratio and actual area ratio describes an arcuate curve 500 in FIG. 21. Conversely, when dampening water is supplied at a high feed rate, the relationship between theoretical area ratio and actual area ratio describes an approximately S-shaped curve 600 in FIG. 21.

Thus, in time of a high feed rate of dampening water, a value ΔS1 obtained by subtracting area ratio S20–150 from area ratio S50–150 is large. In time of a low feed rate of dampening water, the value ΔS1 obtained by subtracting area ratio S20–150 from area ratio S50–150 is small. The value obtained by subtracting area ratio S20–150 may be used as coefficient Y for determining a required feed rate of dampening water.

Next, as in the second embodiment, a range of coefficient Y (or a range to which coefficient Y belongs) is determined (step S64).

Specifically, six ranges from 0 to 5 for the value of Y are set beforehand. Of the six ranges, range 0 is where scumming occurs regardless of the value of coefficient Y, thus requiring a great increase in the feed rate of dampening water. In this event, this embodiment temporarily and forcibly supplies a large quantity of water. Range 1 is for a small value of coefficient Y, which requires a substantial increase in the feed rate of dampening water. Range 2 is for a next small value of coefficient Y, which requires an increase in the feed rate of dampening water. Range 3 is for a medial value of coefficient Y, which does not require a change in the feed rate of dampening water. Range 4 is for a slightly large value of coefficient Y, which requires a decrease in the feed rate of dampening water. Range 5 is for a large value of coefficient Y, which requires a substantial decrease in the feed rate of dampening water. A relationship between coefficient Y and these ranges is determined based on an empirical measurement beforehand.

When the value of coefficient Y calculated belongs to range 3 or lower range, the operation is terminated in favor of the water feeding operation described hereinafter (step S65).

When the value of coefficient Y calculated belongs to range 4 or higher range, area ratio S50–150 calculated previously is compared with a reference value set beforehand (step S66). When this value of area ratio S50–150 is larger than the reference value, the dampening water is determined insufficient. Y is determined to belong to range 2 regardless of its value (step S68), and the operation is terminated in favor of the water feeding operation described hereinafter.

When the value of area ratio S50–150 is smaller than the reference value, the value of area ratio S50–150 in the region E arranged adjacent the middle, among the regions E corresponding to the ink keys 2 shown in FIG. 10 or 16, is compared with the values of area ratio S50–150 in the regions E arranged at opposite ends (step S67). The value of area ratio S50–150 in each of the regions E arranged at the opposite ends is subtracted from the value of area ratio S50–150 in the region E arranged adjacent the middle. When even one of the resulting differences is smaller than a reference value set beforehand, Y is determined to belong to range 2 regardless of its value (step S68), and the operation is terminated in favor of the water feeding operation described hereinafter. When both of the differences are smaller than the reference value, the operation is then terminated in favor of the water feeding operation described hereinafter.

After a range of coefficient Y is determined by the above process, the water feeding operation shown in FIG. 18 is carried out.

First, it is determined whether the number of prints has exceeded 100 (step S51). When the number of prints is less than 100, the printing condition is not stable yet, and the feed rate of dampening water is not adjusted.

When the number of prints is found to exceed 100, a presence or absence of scumming is determined from images of the printing paper 100 after a printing operation photographed at the image pickup portion 40 (step S52). This determination is effected by measuring the density of non-print regions on the printing paper 100, and checking whether the non-print regions are inked. When scumming is determined present, a forced water feeding operation is carried out to feed a large quantity of dampening water temporarily, and thereafter reinstate the feed rate of dampening water (step S53).

Next, whether coefficient Y belongs to range 3 is determined (step S54). When coefficient Y belongs to range 3, it is determined that the feed rate of dampening water is proper, and the operation is terminated.

When coefficient Y does not belong to range 3, whether the range of coefficient Y is lower than range 4 (that is, range 2 or less) is determined (step S55). When the range of coefficient Y is lower than range 4 (that is, range 2 or less), the feed rate of dampening water is increased. When the range of coefficient Y belongs to range 4 or higher, the feed rate of dampening water is decreased (step S56). At this time, the extent of increase or decrease in the feed rate of dampening water is adjusted according to the range of coefficient Y.

In the third embodiment, instead of actually calculating Yule-Nielsen's coefficient N, a fixed value may be used as Yule-Nielsen's coefficient N. In this case, it is possible to omit the detecting patches, shown in FIG. 12, having the same area ratio between the printing area and non-printing area, and different numbers of lines.

This invention may be embodied in other specific forms without departing from the spirit or essential attributes thereof and, accordingly, reference should be made to the appended claims, rather than to the foregoing specification, as indicating the scope of the invention.

This application claims priority benefit under 35 U.S.C. Section 119 of Japanese Patent Applications No. 2003-136752 filed in the Japanese Patent Office on May 15, 2003 and No. 2004-113016 filed in the Japanese Patent Office on Apr. 7, 2004, the entire disclosure of which is incorporated herein by reference.

What is claimed is:

1. A method of controlling a feed rate of dampening water in an offset press, comprising:

a density measuring step for measuring densities of a plurality of detecting patches including a set of detecting patches having an equal number of lines and different area ratios between a printing area and a non-printing area, a set of detecting patches having an equal area ratio between a printing area and a non-printing area and different numbers of lines, and solid patches;

a first calculating step for calculating area ratios S relating to quantities of dampening water by using density of the set of detecting patches having the equal number of lines and different area ratios between the printing area and non-printing area, and density of said solid patches;

a second calculating step for calculating coefficients N relating to emulsification rates of ink by using density of the set of detecting patches having the equal area ratio between the printing area and non-printing area and different numbers of lines, and the density of said solid patches; and a dampening water adjusting step for adjusting the feed rate of dampening water by using said area ratios S and said coefficients N.

2. A method of controlling a feed rate of dampening water in an offset press as defined in claim 1, wherein said second calculating step is executed to determine values of said coefficients N by multiple regression analysis.

3. A method of controlling a feed rate of dampening water in an offset press, comprising:

a density measuring step for measuring densities of a plurality of detecting patches including a set of detecting patches having an equal number of lines and different area ratios between a printing area and a non-printing area, a set of detecting patches having an equal area ratio between a printing area and a non-printing area and different numbers of lines, and solid patches;

a first calculating step for calculating area ratios S relating to quantities of dampening water by substituting density Dm of the set of detecting patches having the equal number of lines and different area ratios between the printing area and non-printing area, and density Ds of said solid patches, into equation (1), set out below, transformed from Yule-Nielsen's relational expression;

a second calculating step for calculating coefficients N relating to an emulsification rate of ink by substituting density Dm of the set of detecting patches having the equal area ratio between the printing area and non-printing area and different numbers of lines, and density Ds of said solid patches, into Yule-Nielsen's relational expression (2) set out below; and a dampening water adjusting step for adjusting the feed rate of dampening water by using said area ratios S and said coefficients N:

$$S=(1-10^{(-Dm/N)})/(1-10^{(-Ds/N)}) \quad (1)$$

$$Dm=-N\cdot\mathrm{Log}\,[1-S(1-10^{(-Ds/N)})] \quad (2).$$

4. A method of controlling a feed rate of dampening water in an offset press as defined in claim 3, wherein said second calculating step is executed to determine values of said coefficients N by multiple regression analysis.

5. A method of controlling a feed rate of dampening water in an offset press, comprising:

a density measuring step for measuring densities of a plurality of detecting patches including a set of detecting patches having an equal number of lines and different area ratios between a printing area and a non-printing area, a set of detecting patches having an equal area ratio between a printing area and a non-printing area and different numbers of lines, and solid patches;

a first calculating step for calculating area ratios S relating to quantities of dampening water by using density of the set of detecting patches having the equal number of lines and different area ratios between the printing area and non-printing area, and density of said solid patches;

a second calculating step for calculating coefficients N relating to emulsification rates of ink for a plurality of numbers of lines by using density of the set of detecting patches having the equal area ratio between the printing area and non-printing area and different numbers of lines, and the density of said solid patches;

a third calculating step for calculating coefficient Z relating to a required feed rate of dampening water from the coefficients N relating to the emulsification rates of ink for the plurality of numbers of lines calculated in said second calculating step; and a dampening water adjusting step for adjusting the feed rate of dampening water by using said area ratios S and said coefficient Z.

6. A method of controlling a feed rate of dampening water in an offset press as defined in claim 5, wherein said third calculating step is executed to calculate an expected value of coefficient N corresponding to a maximum number of lines from two values of coefficients N corresponding to small numbers of lines, and calculate said required feed rate of dampening water from a difference between an actual value of coefficient N corresponding to the maximum number of lines and said expected value.

7. A method of controlling a feed rate of dampening water in an offset press as defined in claim 6, wherein said second calculating step is executed to determine values of said coefficients N by using a multiple regression analysis.

8. A method of controlling a feed rate of dampening water in an offset press, comprising:

a density measuring step for measuring densities of a plurality of detecting patches including a set of detecting patches having an equal number of lines and different area ratios between a printing area and a non-printing area, a set of detecting patches having an equal area ratio between a printing area and a non-printing area and different numbers of lines, and solid patches;

a first calculating step for calculating area ratios S relating to quantities of dampening water by substituting density Dm of the set of detecting patches having the equal number of lines and different area ratios between the printing area and non-printing area, and density Ds of said solid patches, into equation (1), set out below, transformed from Yule-Nielsen's relational expression;

a second calculating step for calculating coefficients N relating to emulsification rates of ink for a plurality of numbers of lines by substituting density Dm of the set of detecting patches having the equal area ratio between the printing area and non-printing area and different numbers of lines, and density Ds of said solid patches, into Yule-Nielsen's relational expression (2) set out below;

a third calculating step for calculating coefficient Z relating to a required feed rate of dampening water from the coefficients N relating to the emulsification rates of ink for the plurality of numbers of lines calculated in said second calculating step; and a dampening water adjusting step for adjusting the feed rate of dampening water by using said area ratios S and said coefficient Z:

$$S=(1-10^{(-Dm/N)})/(1-10^{(-Ds/N)}) \quad (1)$$

$$Dm=-N\cdot\mathrm{Log}\,[1-S(1-10^{(-Ds/N)})] \quad (2).$$

9. A method of controlling a feed rate of dampening water in an offset press as defined in claim 8, wherein said third calculating step is executed to calculate an expected value of coefficient N corresponding to a maximum number of lines from two values of coefficients N corresponding to small numbers of lines, and calculate said required feed rate of dampening water from a difference between an actual value of coefficient N corresponding to the maximum number of lines and said expected value.

10. A method of controlling a feed rate of dampening water in an offset press as defined in claim 9, wherein said second calculating step is executed to determine values of said coefficients N by using a multiple regression analysis.

11. A method of controlling a feed rate of dampening water in an offset press, comprising:

a density measuring step for measuring densities of a plurality of detecting patches including a set of detecting patches having an equal number of lines and different area ratios between a printing area and a non-printing area, and solid patches;

a first calculating step for calculating area ratios S relating to quantities of dampening water for a plurality of numbers of lines by using density of the set of detecting patches having the equal number of lines and different area ratios between the printing area and non-printing area, and density of said solid patches;

a fourth calculating step for calculating a coefficient Y relating to a required feed rate of dampening water from a difference between an area rate S corresponding to a large number of lines and an area rate S corresponding to a small number of lines among said area ratios S relating to quantities of dampening water; and a dampening water adjusting step for adjusting the feed rate of dampening water by using said area ratios S and said coefficient Y.

12. A method of controlling a feed rate of dampening water in an offset press, comprising:

a density measuring step for measuring densities of a plurality of detecting patches including a set of detecting patches having an equal number of lines and different area ratios between a printing area and a non-printing area, a set of detecting patches having an equal area ratio between a printing area and a non-printing area and different numbers of lines, and solid patches;

a first calculating step for calculating area ratios S relating to quantities of dampening water for a plurality of numbers of lines by substituting density Dm of the set of detecting patches having the equal number of lines and different area ratios between the printing area and non-printing area, and density Ds of said solid patches, into equation (1), set out below, transformed from Yule-Nielsen's relational expression;

a second calculating step for calculating coefficients N relating to emulsification rates of ink by substituting density Dm of the set of detecting patches having the equal area ratio between the printing area and non-printing area and different numbers of lines, and density Ds of said solid patches, into Yule-Nielsen's relational expression (2) set out below;

a fourth calculating step for calculating a coefficient Y relating to a required feed rate of dampening water from a difference between an area rate S corresponding to a large number of lines and an area rate S corresponding to a small number of lines among said area ratios S relating to quantities of dampening water; and a dampening water adjusting step for adjusting the feed rate of dampening water by using said area ratios S and said coefficient Y:

$$S=(1-10^{(-Dm/N)})/(1-10^{(-Ds/N)}) \quad (1)$$

$$Dm=-N\cdot\mathrm{Log}\,[1-S(1-10^{(-Ds/N)})] \quad (2).$$

13. A method of controlling a feed rate of dampening water in an offset press as defined in claim 12, wherein said second calculating step is executed to determine values of said coefficients N by using a multiple regression analysis.

* * * * *